US010377532B2

(12) United States Patent
Suphantarida

(10) Patent No.: US 10,377,532 B2
(45) Date of Patent: Aug. 13, 2019

(54) HYBRID-CONSTRUCT BAGS AND METHOD FOR MANUFACTURING HYBRID-CONSTRUCT BAGS

(71) Applicant: Virat Suphantarida, Nakornpathom (TH)

(72) Inventor: Virat Suphantarida, Nakornpathom (TH)

( * ) Notice: Subject to any disclaimer, the term of this patent is extended or adjusted under 35 U.S.C. 154(b) by 0 days.

(21) Appl. No.: 15/574,064

(22) PCT Filed: Dec. 22, 2015

(86) PCT No.: PCT/TH2015/000092
§ 371 (c)(1),
(2) Date: Nov. 14, 2017

(87) PCT Pub. No.: WO2017/111705
PCT Pub. Date: Jun. 29, 2017

(65) Prior Publication Data
US 2018/0290790 A1 Oct. 11, 2018

(51) Int. Cl.
*B65D 30/24* (2006.01)
*B65D 5/06* (2006.01)
*B65D 33/01* (2006.01)

(52) U.S. Cl.
CPC ..... *B65D 31/142* (2013.01); *B65D 5/061* (2013.01); *B65D 33/01* (2013.01)

(58) Field of Classification Search
CPC ..... B65D 31/142; B65D 5/061; B65D 33/01
(Continued)

(56) References Cited

U.S. PATENT DOCUMENTS 2,040,336 A * 5/1936 Rosmait ..... B65D 31/14 383/44
2,359,033 A * 9/1944 Gottwald ..... B65D 31/142 383/3

(Continued)

FOREIGN PATENT DOCUMENTS

CN 2353665 Y 12/1999
CN 2740545 Y 11/2005

(Continued)

OTHER PUBLICATIONS

International Search Report in corresponding International Application No. PCT/TH2015/000092 issued by State Intellectual Property Office of China as International Searching Authority, dated Sep. 27, 2016, 4 pages.

(Continued)

*Primary Examiner* — Jes F Pascua
(74) *Attorney, Agent, or Firm* — Baker & McKenzie LLP

(57) ABSTRACT

Provided is a hybrid-construct bag, comprising a bag body formed by at least a first sheet, the bag body having: a substantially tubular main body portion, a first end portion, a second end portion, a valve section formed at the first end portion and configured to form the channel between the top and bottom walls which are included in the valve section, and a patch section, wherein the main body portion, first end portion and second end portion cooperatively form a cavity operable to receive contents. There are a plurality of perforations formed in the main body portion and used for allowing a gas to pass though and resisting a liquid and/or particulates to pass though. A method of forming the hybrid-construct bag is also disclosed.

21 Claims, 9 Drawing Sheets

(58) Field of Classification Search
USPC ..... 383/42, 44, 100–103, 125, 126
See application file for complete search history.

(56) References Cited

U.S. PATENT DOCUMENTS

| | | | | | |
|---|---|---|---|---|---|
| 3,439,864 | A * | 4/1969 | Kasting | B65D 31/08 | 383/100 |
| 4,579,226 | A | 4/1986 | Blake et al. | | |
| 5,967,664 | A * | 10/1999 | Giles | B65D 31/142 | 383/109 |
| 5,988,881 | A * | 11/1999 | Sutherland | B65D 33/01 | 383/103 |
| 6,186,393 | B1 | 2/2001 | Tsamourgelis | | |
| 6,883,964 | B2 * | 4/2005 | Beaulieu | B65D 31/02 | 383/101 |
| 2005/0069231 | A1 * | 3/2005 | Mohamed | B65D 29/02 | 383/125 |

FOREIGN PATENT DOCUMENTS

| | | | |
|---|---|---|---|
| CN | 2895258 | Y | 5/2007 |
| CN | 104149994 | A | 11/2014 |

OTHER PUBLICATIONS

Written Opinion of the International Searching Authority in corresponding International Application No. PCT/TH2015/000092 issued by State Intellectual Property Office of China, dated Sep. 27, 2016, 4 pages.

* cited by examiner

HYBRID-CONSTRUCT BAGS AND METHOD FOR MANUFACTURING HYBRID-CONSTRUCT BAGS

TECHNICAL FIELD

The present disclosure relates generally to bags, and more specifically, the present disclosure relates generally to bags having a hybrid construct for use in receiving contents, and methods for manufacturing same.

BACKGROUND

There are a variety of bags (or sacks) in use today. In general, bags are used in a plurality of applications and for a plurality of contents, and come in a plurality of shapes and sizes. Bags are generally manufactured using one type of construct (or composition or material), such as a sheet made of a material or mixture of materials that form a single sheet, from among a plurality of available constructs. For example, presently available bags include those made of paper, fabric, plastic, or other material compositions.

In respect to contents received and stored in bags, such as cement and/or other contents in particulate form (e.g., those of granular and/or powder form, and the like), it is generally desirable to have bags that are sufficiently strong and durable, while also easy to fill and resist leakage of contents. Another attribute of bags that has become desirable is the ability for bags to sufficiently protect such contents from external moisture (e.g., water), and the like.

BRIEF SUMMARY

It is recognized in the present disclosure that there is a general tradeoff in respect to the attributes of bags available in the market today. For example, paper-based bags (or "paper bags") are, in general, relatively affordable and easy to produce, and also enable finely detailed printing to be effected thereon. However, paper bags are prone to damage resulting from external moisture (e.g., puddles, humidity, damp surroundings, etc.). Furthermore, paper bags are prone to damage during a content filling process. For example, when a metal nozzle, tube, or the like, is used to pour or inject contents into the paper bag's cavity, the paper valve section of paper bags oftentimes becomes damaged (i.e., ripped, torn, punctured, and/or scratched) when the metal nozzle, tube, or the like, is inserted into and/or removed from the paper valve section. Paper bags are also prone to content leakage, especially when its contents are in particulate form. Common leakage areas of paper bags are the paper valve section, as well as the top and bottom ends of the paper bag. Paper bags are also prone to damage when impacted with a certain amount of force (such as when dropped or thrown, or placed under heavy loads). Common damaged sections of paper bags when impacted are the paper valve section and the top and bottom ends of the paper bag.

Present example embodiments relate generally to bags, and more specifically, to bags of the hybrid-construct type and methods for forming or manufacturing hybrid-construct bags.

In an exemplary embodiment, a hybrid construct bag is described. The bag may include a bag body, a valve section, and a patch section. The bag body may be formed by at least a first sheet. The first sheet may be a paper-based sheet having a laminate layer formed over at least a portion of the paper-based sheet. The bag body may include a substantially tubular main body portion formed by securing a first end of the first sheet to a second end of the first sheet in such a way that an outer surface of the main body portion includes the laminate layer. The bag body may also include a first end portion formed by folding a plurality of portions of a third end of the first sheet in such a way that an outer surface of the first end portion includes the laminate layer. The bag body may also include a second end portion opposite to the first end portion. The second end portion may be formed by folding a plurality of portions of a fourth end of the first sheet in such a way that an outer surface of the second end portion includes the laminate layer. In respect to the valve section, the valve section may be formed at the first end portion. The valve section may include a top wall and a bottom wall formed between folded portions of the first end portion. The valve section may be configurable to be substantially tubular in shape in such a way as to form a channel between the top and bottom walls. The valve section may also be configurable to be in a folded position in such a way that the top wall is in contact with the bottom wall. At least one of the top wall and bottom wall may be formed by a second sheet different from the first sheet. The second sheet may be a fabric-based sheet. The valve section may be secured to the first end portion via the laminate layer of the first end portion. In respect to the patch section, the patch section may be formed by at least a third sheet different from the first sheet. The third sheet may be a fabric-based sheet. The patch section may be secured to the first end portion via the laminate layer of the first end portion. The main body portion, first end portion, and second end portion may cooperatively form a cavity operable to receive contents. When the valve section is configured to form the channel between the top and bottom walls, the valve section may be operable to enable contents to be received into the cavity. At least a portion of the first sheet forming the main body portion may include a plurality of perforations. Each of the perforations may be operable to allow a gas to pass through. Each of the perforations may be operable to resist a liquid and/or particulates from passing through.

In another exemplary embodiment, a hybrid-construct bag is described. The hybrid construct bag may include a bag body and a patch section. The bag body may be formed by at least a first sheet. The first sheet may be a paper-based sheet having a laminate layer formed over at least a portion of the paper-based sheet. The bag body may include a substantially tubular main body portion formed by securing a first end of the first sheet to a second end of the first sheet in such a way that an outer surface of the main body portion includes the laminate layer. The bag body may further include a first end portion formed by folding a plurality of portions of a third end of the first sheet in such a way that an outer surface of the first end portion includes the laminate layer. The bag body may further include a second end portion opposite to the first end portion. The second end portion may be formed by folding a plurality of portions of a fourth end of the first sheet in such a way that an outer surface of the second end portion includes the laminate layer. In respect to the patch section, the patch section may be formed by at least a second sheet different from the first sheet. The second sheet may be a fabric-based sheet. The patch section may be secured to the first end portion via the laminate layer of the first end portion. The main body portion, first end portion, and second end portion may cooperatively form a cavity operable to receive contents. At least a portion of the first sheet forming the main body portion may include a plurality of perforations. Each of the perforations may be operable to allow a gas to pass through.

Each of the perforations may be operable to resist a liquid and/or particulates from passing through.

In another exemplary embodiment, a hybrid construct bag is disclosed. The bag may include a bag body and a valve section. The bag body may be formed by at least a first sheet. The first sheet may be a paper-based sheet having a laminate layer formed over at least a portion of the paper-based sheet. The bag body may include a substantially tubular main body portion formed by securing a first end of the first sheet to a second end of the first sheet in such a way that an outer surface of the main body portion includes the laminate layer. The bag body may further include a first end portion formed by folding a plurality of portions of a third end of the first sheet in such a way that an outer surface of the first end portion includes the laminate layer. The bag body may further include a second end portion opposite to the first end portion. The second end portion may be formed by folding a plurality of portions of a fourth end of the first sheet in such a way that an outer surface of the second end portion includes the laminate layer. In respect to the valve section, the valve section may be formed at the first end portion. The valve section may include a top wall and a bottom wall formed between folded portions of the first end portion. The valve section may be configurable to be substantially tubular in shape in such a way as to form a channel between the top and bottom walls. The valve section may also be configurable to be in a folded position in such a way that the top wall is in contact with the bottom wall. At least one of the top wall and bottom wall may be formed by a second sheet different from the first sheet. The second sheet may be a fabric-based sheet. The valve section may be secured to the first end portion via the laminate layer of the first end portion. The main body portion, first end portion, and second end portion may cooperatively form a cavity operable to receive contents. When the valve section is configured to form the channel between the top and bottom walls, the valve section may be operable to enable contents to be received into the cavity. At least a portion of the first sheet forming the main body portion may include a plurality of perforations. Each of the perforations may be operable to allow a gas to pass through. Each of the perforations may be operable to resist a liquid and/or particulates from passing through.

BRIEF DESCRIPTION OF THE DRAWINGS

For a more complete understanding of the present disclosure, example embodiments, and their advantages, reference is now made to the following description taken in conjunction with the accompanying drawings, in which like reference numbers indicate like features, and.

Although similar reference numbers may be used to refer to similar elements in the figures for convenience, it can be appreciated that each of the various example embodiments may be considered to be distinct variations.

Figure 1:
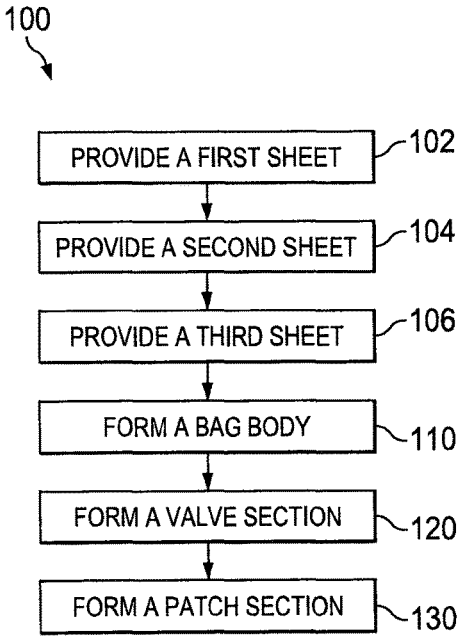
FIG. 1 is an example embodiment of a method for forming an example embodiment of a hybrid-construct bag.

Example embodiments will now be described with reference to the accompanying drawings, which form a part of the present disclosure and which illustrate example embodiments which may be practiced. As used in the present disclosure and the appended claims, the terms "example embodiment," "exemplary embodiment," and "present embodiment" do not necessarily refer to a single embodiment, although they may, and various example embodiments may be readily combined and/or interchanged without departing from the scope or spirit of example embodiments. Furthermore, the terminology as used in the present disclosure and the appended claims is for the purpose of describing example embodiments only and is not intended to be limitations. In this respect, as used in the present disclosure and the appended claims, the term "in" may include "in" and "on," and the terms "a," "an," and "the" may include singular and plural references. Furthermore, as used in the present disclosure and the appended claims, the term "by" may also mean "from," depending on the context. Furthermore, as used in the present disclosure and the appended claims, the term "if" may also mean "when" or "upon," depending on the context. Furthermore, as used in the present disclosure and the appended claims, the words "and/or" may refer to and encompass any and all possible combinations of one or more of the associated listed items.

DETAILED DESCRIPTION

It is recognized in the present disclosure that tradeoffs generally exist in respect to attributes of bags (or sacks) available today. Such trade-offs may be understood by way of the following non-limiting examples.

In respect to paper bags, for example, while paper bags are, in general, relatively affordable and easy to produce and enable finely detailed printing to be effected thereon, paper bags are prone to damage resulting from an exposure to external moisture (e.g., puddles, rain, humidity, damp surroundings, etc.). External moisture will typically cause paper bags to become damaged and, as a result, fail to sufficiently protect and fully secure contents stored therein.

Another disadvantage in respect to paper bags pertains to its proneness to damage during a filling process. For example, paper bags are commonly used for storing, among other contents, cement, sand, flour, and/or other contents in particulate form (e.g., those of granular and/or powder form, and the like). Such paper bags will include a closed bottom end, a top end, and an opening section in the top end of the paper bag (e.g., a paper valve section) for use in receiving a metal nozzle, tube, or the like, that pours contents into the paper bag's cavity. It is recognized in the present disclosure that the paper valve section of paper bags oftentimes become damaged (i.e., ripped, torn, punctured, and/or scratched) when the metal nozzle, tube, or the like, is inserted into and/or removed from the paper valve section. In such situations, the paper bag will become damaged, may need to be discarded, and/or may interrupt the filling process.

Another disadvantage in respect to paper bags pertains to its proneness to content leakage, especially when its contents are in particulate form. In this regard, the most common sections of a paper bag that are prone to content leakage are the paper valve section, as well as the top and bottom ends of the paper bag, which are each formed by folding the paper used to form the paper bag into closed ends.

Another example disadvantage in respect to paper bags pertains to its proneness to damage when impacted with a certain amount of force, such as when dropped or thrown, or placed under heavy loads. In such situations, the most common sections of a paper bag that become damaged when impacted are the paper valve section and the top and bottom ends of the paper bag, and in particular, the corners and folded sections of the top and bottom ends, which may come apart from one another and/or become torn.

Present example embodiments relate generally to and/or comprise systems, subsystems, bags, sacks, and methods for addressing conventional problems, including those described above and in the present disclosure, and more specifically, example embodiments relate to hybrid-construct bags and methods for manufacturing hybrid-construct bags. It is to be understood in the present disclosure that the terms "hybrid bag," "hybrid-construct bag," "hybrid-construction bag," and/or the like, may be interchangeably used to refer to bags having one or more portions that are formed using different constructs (or sheets, compositions, or materials). These example embodiments will now be described below with reference to the accompanying drawings, which form a part of the present disclosure.

Example Embodiments of a Method of Forming Hybrid-construct Bags (e.g., Method 100).

Figure 4:
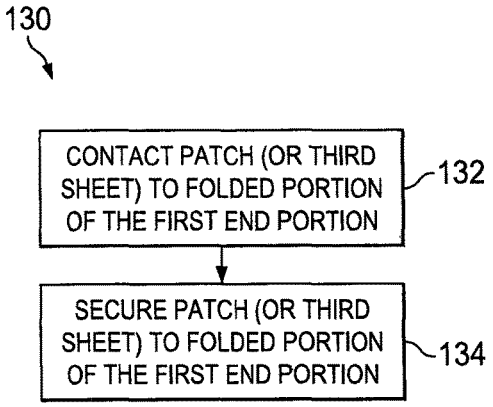
FIG. 4 is an example embodiment of a method of forming an example embodiment of a patch section.
Figure 5A:
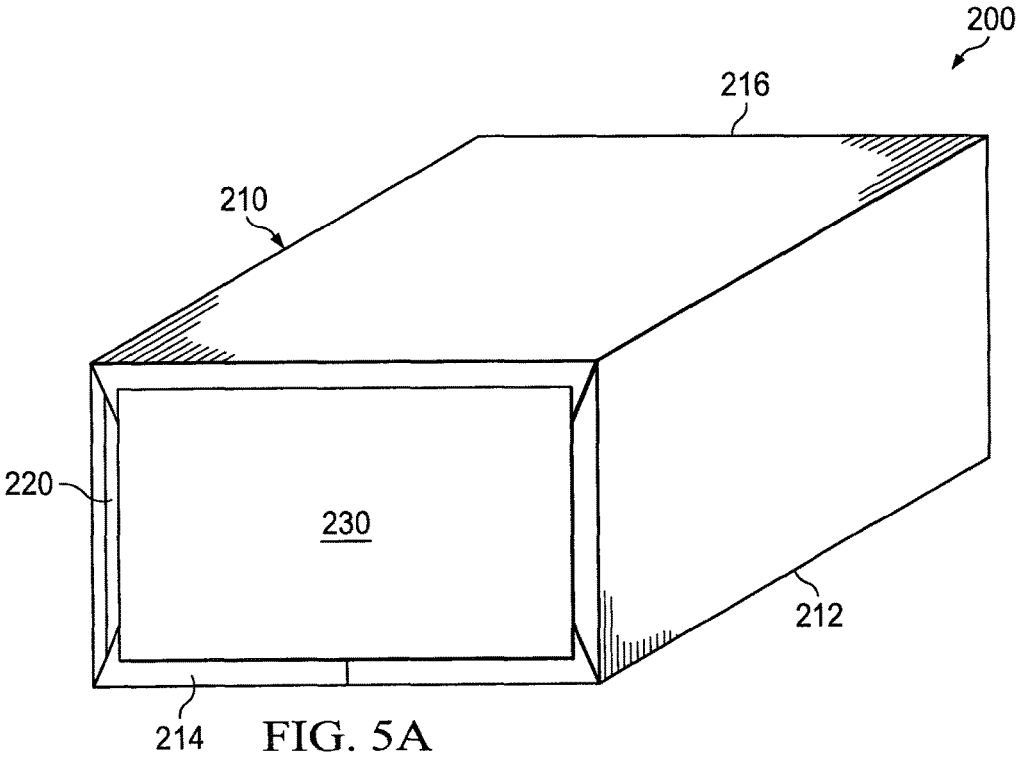
FIG. 5A is a perspective view of an example embodiment of a hybrid-construct bag.
Figure 5B:
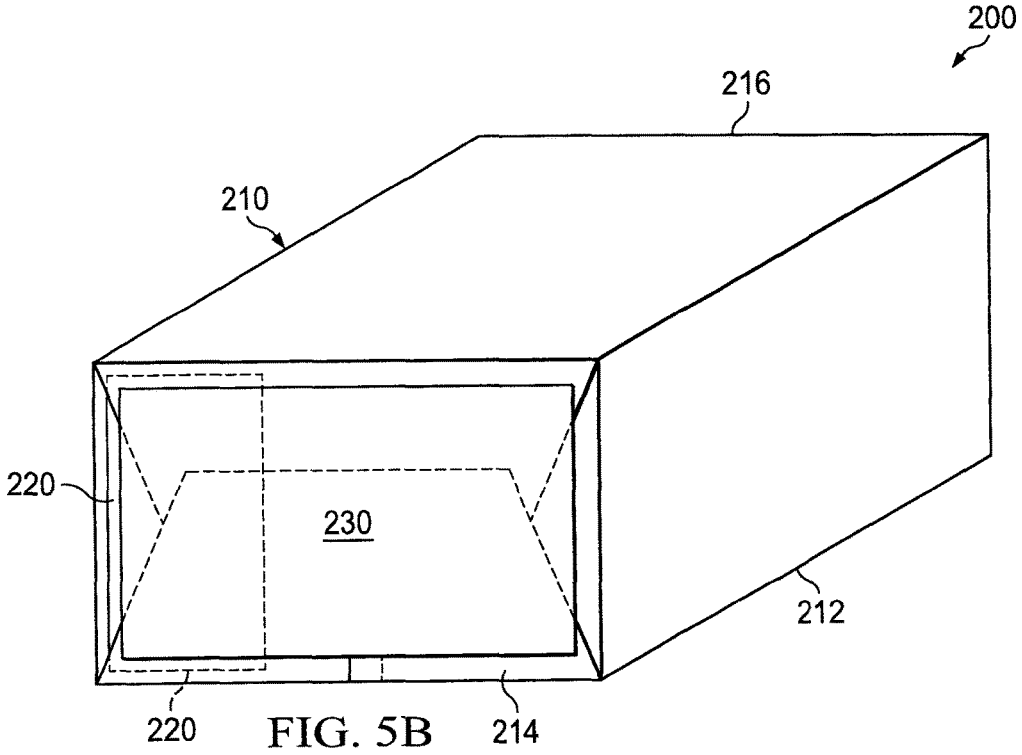
FIG. 5B is another perspective view of an example embodiment of a hybrid-construct bag.
Figure 5C:
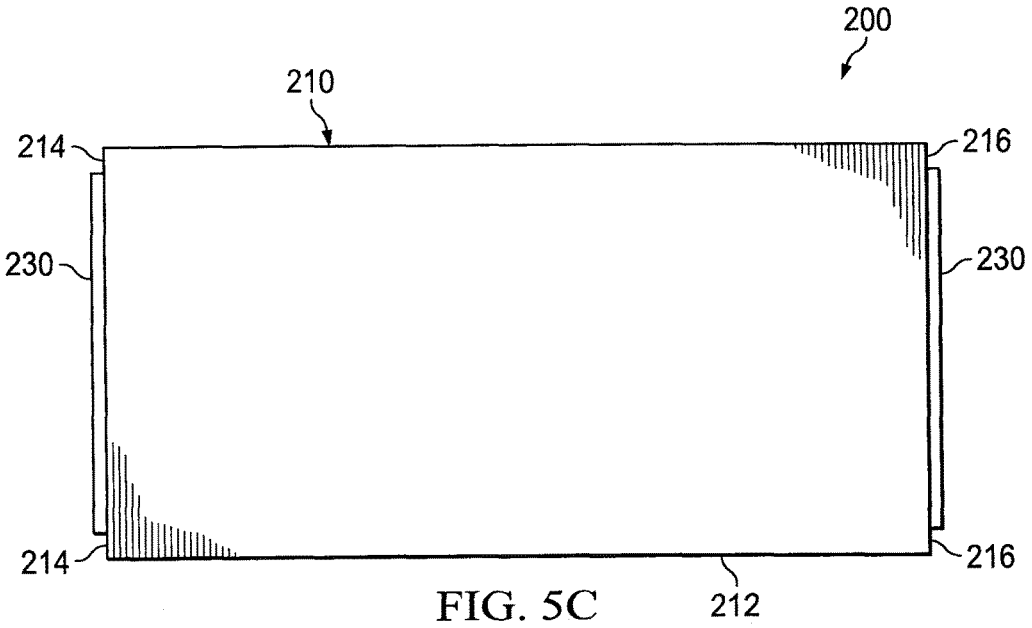
FIG. 5C is a side view of an example embodiment of a hybrid-construct bag.

FIG. 1 and FIGS. 2, 3, 4, and 6A-L illustrate example embodiments of a method (e.g., method 100) of forming hybrid-construct bags (e.g., bag 200, as illustrated in at least FIG. 5A, FIG. 5B, and FIG. 5C). Example embodiments of the method 100 may include, but are not limited to, one or more of the following actions: (1) providing a first sheet (e.g., action 102, first sheet 1), (2) providing a second sheet (e.g., action 104), (3) providing a third sheet (e.g., action 106), (4) forming a bag body (e.g., action 110, bag body 210), (5) forming a valve section (e.g., action 120, valve section 220), and/or (6) forming a patch section (e.g., action 130, patch section 230).

Example embodiments of the bag (e.g., bag 200), such as hybrid-construct valve bags, may be formed according to one or more of the above actions, may include additional actions, may be performable in different sequences, and/or one or more of the actions may be combinable into a single action or divided into two or more actions. Bags other than valve bags are also contemplated in example embodiments without departing from the teachings of the present disclosure. These actions and bags will now be described with references to FIGS. 1-6.

(1) Providing a First Sheet (e.g., Action 102).

Figure 6A:
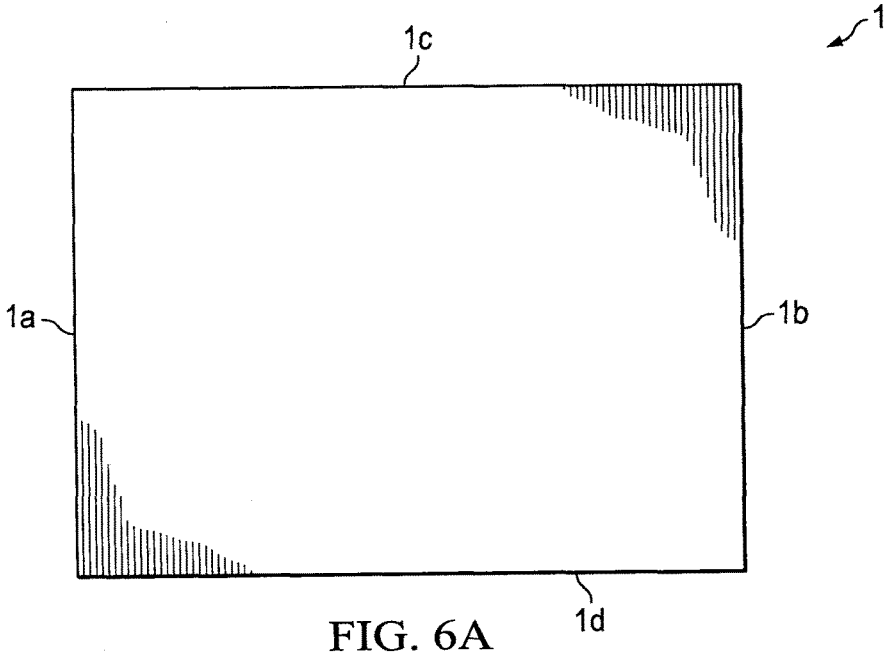
FIG. 6A is a top view of an example embodiment of a first sheet.

FIG. 6A illustrates an example embodiment of a first sheet 1. The first sheet 1 may be provided (e.g., action 102) for use in forming the bag body (e.g., action 110, bag body 210). The first sheet 1 may include a first end 1*a*, second end 1*b* opposite to the first end 1*a*, third end 1*c*, and fourth end 1*d* opposite to the third end 1*c*. In an example embodiment, the first sheet 1 may be a paper-based sheet having one or more laminate layers formed over at least a portion of the paper-based sheet. For example, the paper-based sheet may have a laminate layer formed on one or both sides. Although references in the present disclosure to the first sheet 1 are directed to paper-based sheets having a laminate layer formed over at least a portion of the paper-based sheet, it is to be understood in the present disclosure that the first sheet 1 may also be other types of sheets including, but not limited to, a paper-based sheet having a coating formed over at least a portion of one or both sides of the paper-based sheet, a paper-based sheet having a laminate layer formed over at least a portion of one or both sides of the paper-based sheet, non-paper-based sheets, etc.

The method 100 may further comprise forming a plurality of perforations (or holes) in at least a portion of the first sheet 1. Each perforation may have a circular shape. It is to be understood in the present disclosure that the perforations may be formed in one or more of a plurality of shapes and sizes including, but not limited to, a circle, oval, square, rectangle, triangle, etc. without departing from the teachings of the present disclosure. The first sheet 1 may have a density of perforations between about 5 to 256 perforations per $cm^2$. In situations wherein the first sheet 1 is a paper-based sheet having a laminate layer formed over the paper-based sheet, the method 100 may include forming a plurality of perforations through both the paper-based sheet and the laminate layer. In example embodiments, the perforations may be formed throughout the entire first sheet 1, or alternatively, in only certain sections of the first sheet 1, such as in the center portion(s) of the first sheet 1 corresponding to those portion(s) of the first sheet 1 that eventually form the main body portion 212 of the bag body 210.

It is recognized in the present disclosure that, in applications wherein the contents stored or to be stored in the bag 200 are particulates, such as cement, or the like, the pouring or injecting of the particulates via a tube, or the like, into a valve section (e.g., valve section 220) of the bag 200 will typically introduce air or other gases into the cavity (e.g., cavity 218) of the bag 200 during the filling process. During such filling process, the introduced air or other gases oftentimes cause the contents to scatter and/or escape from the bag 200 via the valve section 220, and may possibly interrupt the filling process. In this regard, in example embodiments, the perforations formed in the first sheet 1 may be appropriately sized, shaped, and/or spaced so as to be operable to assist and/or improve the filling of contents into the bag 200 by enabling the introduced air or other gases to pass through the perforations of the first sheet 1. In example embodiments, the size, shape, and/or spacing of the perforations formed in the first sheet 1 may be selected based on the contents so as to prevent the contents stored or to be stored in the bag 200 from passing through the perforations. In addition to or in replacement, the size, shape, and/or spacing of the perforations formed in the first sheet 1 may be selected so as to prevent liquids and/or moisture, such as water, from passing through the perforations.

In example embodiments wherein the first sheet 1 is a paper-based sheet having a laminate layer (or a coating), the laminate layer (or coating) may include, among other components, polypropylene (PP), polyethylene (PE), elastomer, cast polypropylene (CPP), bi-axially oriented polypropylene (BOPP), nylon, etc. Other compositions of the laminate layer (or coating) are contemplated without departing from the teachings of the present disclosure.

In respect to the dimensions of the first sheet 1, the first sheet 1 may be sized to include dimensions based on, among other considerations, the desired dimensions of the bag 200, the desired dimensions and/or strength of the seams or connections of the bag 200, the desired dimensions and/or strength of the folds of the bag 200 at the ends of the bag 200 (e.g., first end portion 214 and/or second end portion 216), etc.

The paper-based sheet of the first sheet 1 may have a weight, such as an average weight, of between about 30 gsm to 200 gsm. In respect to the laminate layer (or coating) formed over the paper-based sheet, the laminate layer (or coating) may have a thickness, such as an average thickness, of between about 5 to 100 microns.

It is to be understood in the present disclosure that the first sheet 1 may be provided in any one or more of a plurality of other ways as known by those having ordinary skill in the art.

(2) Providing a Second Sheet (e.g., Action 104).

As illustrated in FIG. 1, the method 100 may further comprise providing a second sheet (e.g., action 104). The second sheet may be for use in forming at least a portion of the valve section (e.g., action 120, valve section 220). The second sheet may be a fabric-based sheet in example embodiments. For example, the fabric-based sheet may be a polypropylene (PP) woven fabric with or without a laminate layer formed over at least a portion of one or both sides. Although references in the present disclosure to the second sheet may be directed to woven fabric-based sheets having a laminate layer formed thereon, it is to be understood in the present disclosure that the second sheet may also be other types of sheets including, but not limited to, PP woven fabric-based sheets without a laminate layer formed on any side, non-woven fabric-based sheets with or without a laminate layer, a paper-based sheet, HDPE, LLDPE, PE woven fabrics, HDPE, LDPE, LLDPE, PP, PE, non-woven fabrics, paper, plastic film, etc.

In some embodiments, the method 100 may further comprise forming a plurality of perforations in at least a portion of the second sheet, and such perforations may be formed in a similar or substantially the same manner as described above for the first sheet 1. Each perforation in the second sheet may have a circular shape. It is to be understood in the present disclosure that the perforations may be formed in one or more of a plurality of shapes and sizes including, but not limited to, a circle, oval, square, rectangle, triangle, etc. without departing from the teachings of the present disclosure. The second sheet may have a density of perforations of between about 5 to 256 perforations per $cm^2$. In situations wherein the second sheet is a woven fabric-based sheet (which may already have perforations) that includes a laminate layer, the method 100 may include forming a plurality of perforations through the laminate layer.

In example embodiments wherein the second sheet is a woven fabric-based sheet, the second sheet may include, but is not limited to, polypropylene, HDPE, LLDPE, PE woven fabrics, HDPE, LDPE LLDPE PP PE non woven fabrics, paper, plastic, film, etc. Other compositions of the second sheet are contemplated without departing from the teachings of the present disclosure.

The second sheet may be sized to include dimensions based on, among other considerations, the dimensions of the first end portion 214 of the bag 200, the fold patterns of the first end portion 214 of the bag 200, the dimensions of the valve section 220, the type of contents to be received and stored in the bag 200, etc.

The second sheet may have a thickness, such as an average thickness, of between about 5 to 280 microns. If the second sheet includes a laminate layer, the laminate layer may have a thickness, such as an average thickness, of between about 10 to 300 microns.

It is to be understood in the present disclosure that the second sheet may be provided in any one or more of a plurality of other ways as known by those having ordinary skill in the art.

(3) Providing a Third Sheet (e.g., Action 106).

In an example embodiment, the method 100 may further comprise providing a third sheet (e.g., action 106). The third sheet may be for use in forming the patch section for the first end portion 214 and/or second end portion 216 of the bag 200 (e.g., action 130, patch section 230). The third sheet may be a fabric-based sheet in example embodiments. For example, the fabric-based sheet may be a polypropylene (PP) woven fabric with or without a laminate layer formed over at least a portion of one or both sides. Although references in the present disclosure to the third sheet may be directed to woven fabric-based sheets having a laminate layer formed thereon, it is to be understood in the present disclosure that the third sheet may also be other types of sheets including, but not limited to, PP woven fabric-based sheets without a laminate layer formed on any side, non-woven fabric-based sheets with or without a laminate layer, a paper-based sheet, HDPE, LLDPE, PE woven fabrics, HDPE, LDPE, LLDPE, PP, PE, non-woven fabrics, paper, plastic, film, etc.

In some embodiments, the method 100 may or may not comprise forming a plurality of perforations in at least a portion of the third sheet, and if formed, such perforations may be formed in a similar or substantially the same manner as described above for the first sheet 1 and/or second sheet. Each perforation in the third sheet may have a circular shape. It is to be understood in the present disclosure that the perforations may be formed in one or more of a plurality of shapes and sizes including, but not limited to, a circle, oval, square, rectangle, triangle, etc. without departing from the teachings of the present disclosure. The third sheet may have a density of perforations of between about 5 to 256 perforations per $cm^2$. In situations wherein the third sheet is a woven fabric-based sheet (which may already have perforations) that includes a laminate layer, the method 100 may include forming a plurality of perforations through the laminate layer.

In example embodiments wherein the third sheet is a woven/fabric-based sheet, the third sheet may include, but is HDPE, LLDPE, PE woven fabrics, HDPE, LDPE, LLDPE, PP, PE, non-woven fabrics, paper, plastic, film, etc. Other compositions of the third sheet are contemplated without departing from the teachings of the present disclosure.

The third sheet may be sized to include dimensions based on, among other considerations, the dimensions of the first end portion 214 and/or second end portion 216 of the bag 200, the type of contents to be received and stored in the bag

200, the desired strength of the bag, the fold patterns of the first end portion 214 and/or second end, portion 216 of the bag 200, etc.

The third sheet may have a thickness of between about 25 to 200 microns. If the third sheet includes a laminate layer, the laminate layer may have a thickness, such as an average thickness, of between about 10 to 150 microns.

It is to be understood in the present disclosure that the third sheet may be provided in any one or more of a plurality of other ways as known by those having ordinary skill in the art. It is also to be understood in the present disclosure that the composition of the second sheet and the third sheet may be the same as, similar to, and/or distinct from one another without departing from the teachings of the present disclosure.

(4) Forming a Bag Body (e.g., Action 110).

Figure 2:
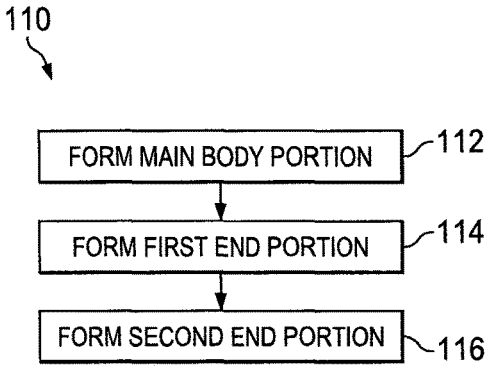
FIG. 2 is an example embodiment of a method for forming an example embodiment of a bag body.

As illustrated in FIG. 1 and FIG. 2, the method 100 may further comprise forming a bag body (e.g., action 110, bag body 210). The bag body 210 may be formed by at least a sheet (e.g., first sheet 1). The first sheet 1 may be a paper-based sheet having a laminate layer formed over at least a portion of the paper-based sheet, as described above and in the present disclosure. It is to be understood that the bag body 210 may include one or more additional sheets, such as paper-based sheets, stacked along with the first sheet 1 without departing from the teachings of the present disclosure. In this regard, the one or more additional sheets may assist in providing, among other things, additional strength to the overall bag 200. In situations wherein the additional sheets are included for the bag body 210, the additional sheets may also include perforations in a similar manner as those described above and in the present disclosure.

Figure 6B:
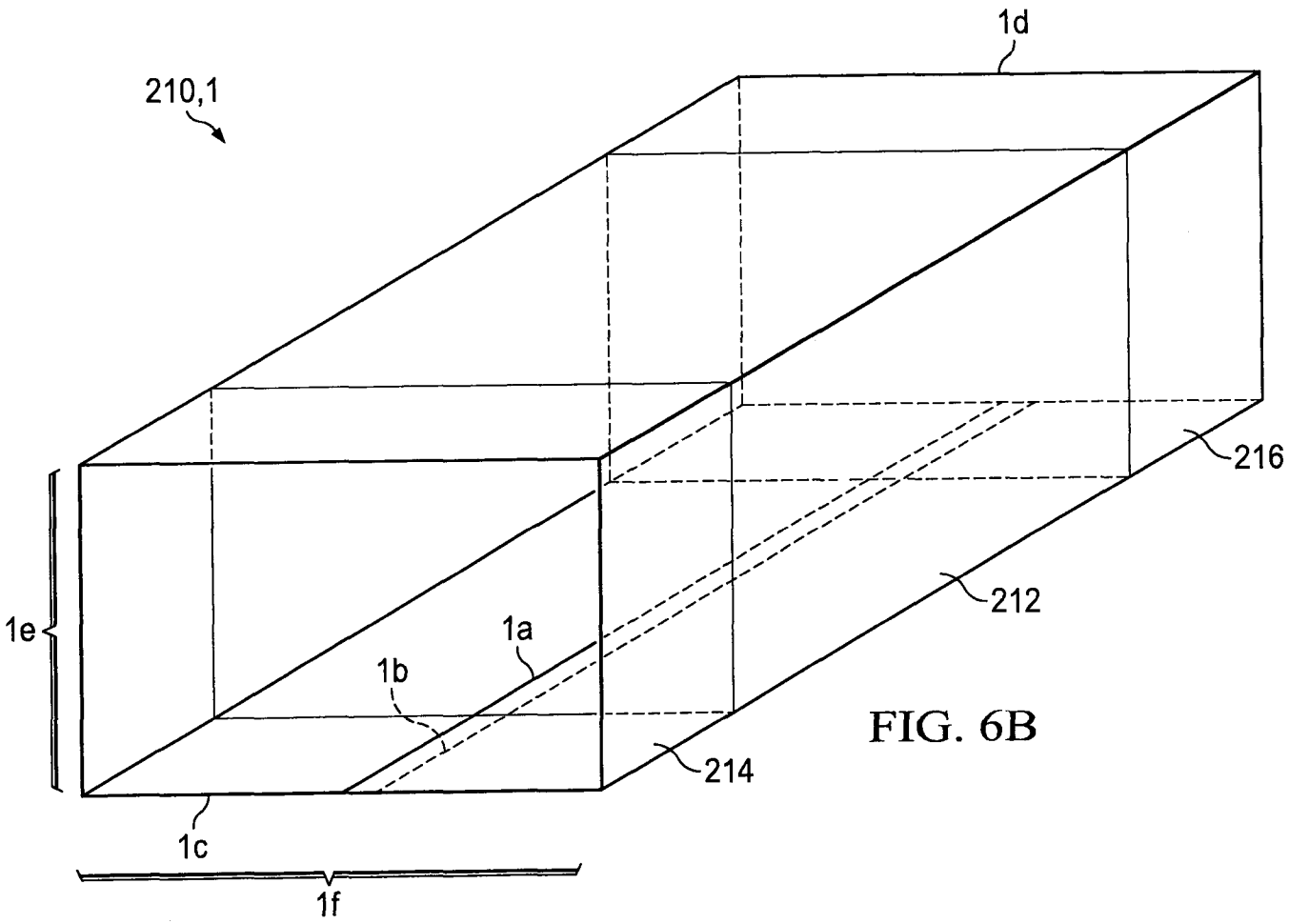
FIG. 6B is a perspective view of securing a first end and second end of the first sheet.

As illustrated in at least FIG. 6B, in an example embodiment, the bag body 210 may be formed by securing a first end (e.g., first end 1*a*) of the first sheet 1 to a second end (e.g., second end 1*b*) of the first sheet 1. Such securing of the first end 1*a* to the second end 1*b* may be performed in such a way that an outer surface of the bag body 210 includes the laminate layer of the first sheet 1. The first end 1*a* may be secured to the second end 1*b* in one or more of a plurality of ways including, but not limited to, applying an adhesive (such as glue) on one or both of the first end 1*a* and second end 1*b*, applying a temperature to bond (e.g., melt) the respective laminate layers of the first end 1*a* and second end 1*b* (as described in the present disclosure), etc.

The bag body 210 may include a substantially tubular main body portion (e.g., main body portion 212), a first end portion (e.g., first end portion 214), and a second end portion (e.g., second end portion 216). The main body portion 212 may be formed (e.g., action 112) in one or more of a plurality of shapes including, but not limited to, a rectangle, a square, a cylinder, etc.

Figure 6C:
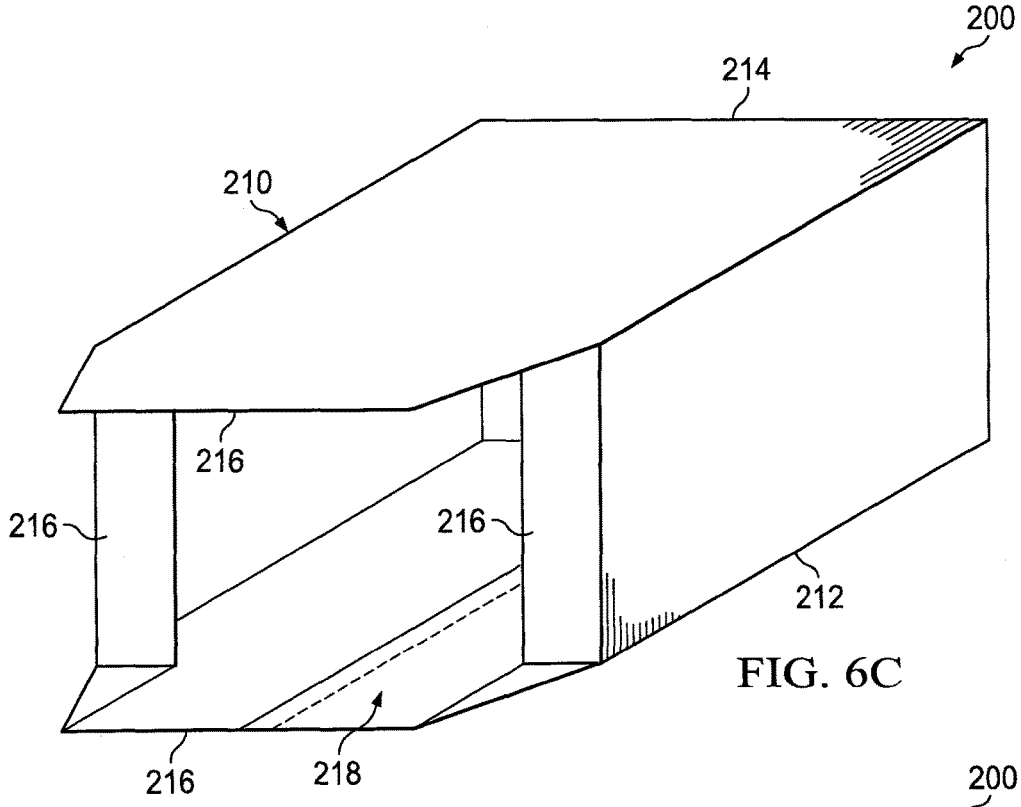
FIG. 6C is a perspective view of forming a second end portion of the hybrid-construct bag.
Figure 6D:
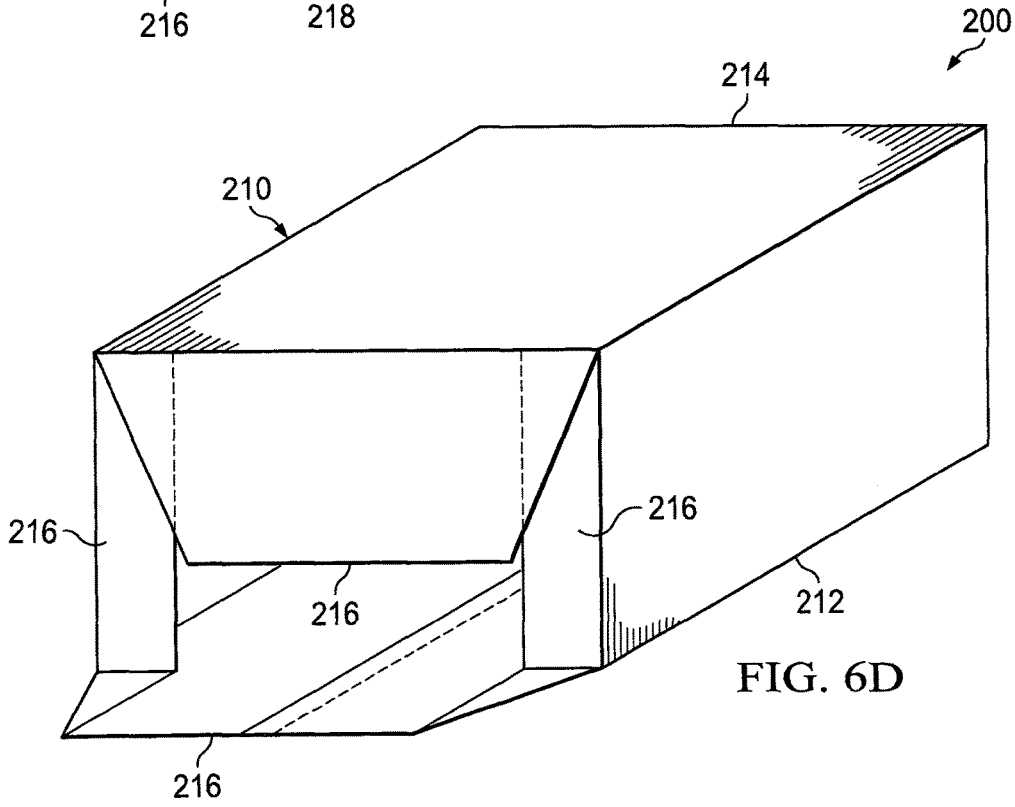
FIG. 6D is another perspective view of forming a second end portion of the hybrid-construct bag.
Figure 6E:
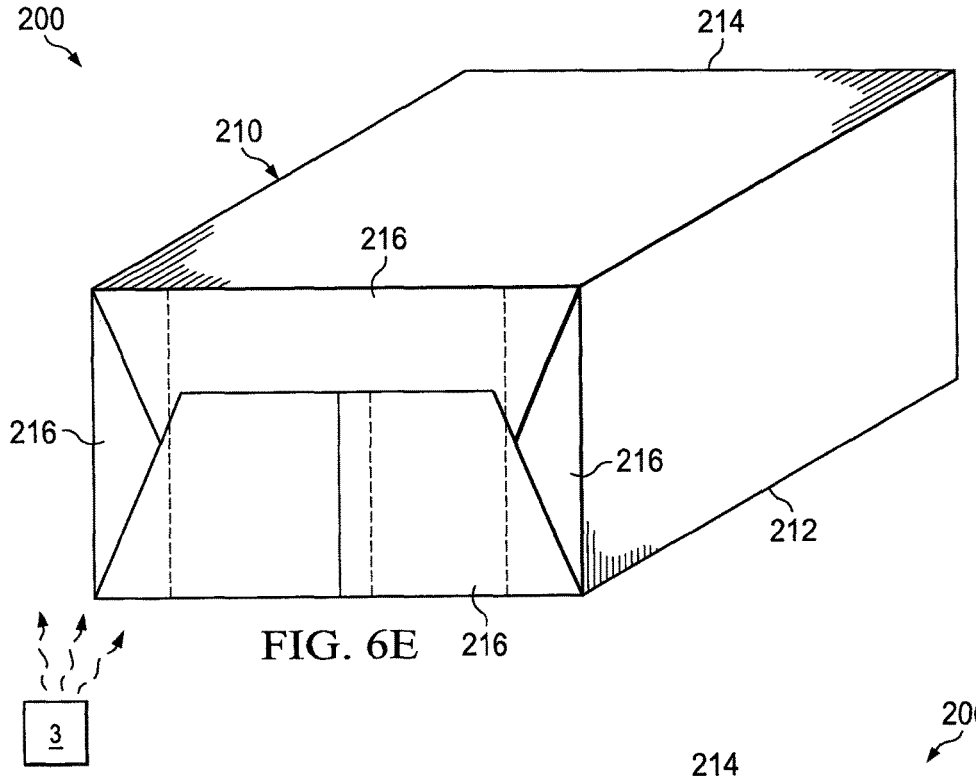
FIG. 6E is another perspective view of forming a second end portion of the hybrid-construct bag.

In respect to the second end portion 216, FIG. 6C, FIG. 6D, and FIG. 6E illustrate an example embodiment of actions for forming the second end portion 216 (e.g., action 116). The second end portion 216 may be formed by first folding a plurality of portions of a fourth end (e.g., fourth end 1*d*) of the first sheet 1, and such folding may be performed in such a way that an outer surface of the second end portion 216 includes the laminate layer of the first sheet 1. It is to be understood that the second end portion 216 may be formed in one or more of a plurality of other ways, configurations, and/or fold patterns without departing from the teachings of the present disclosure.

Figure 6F:
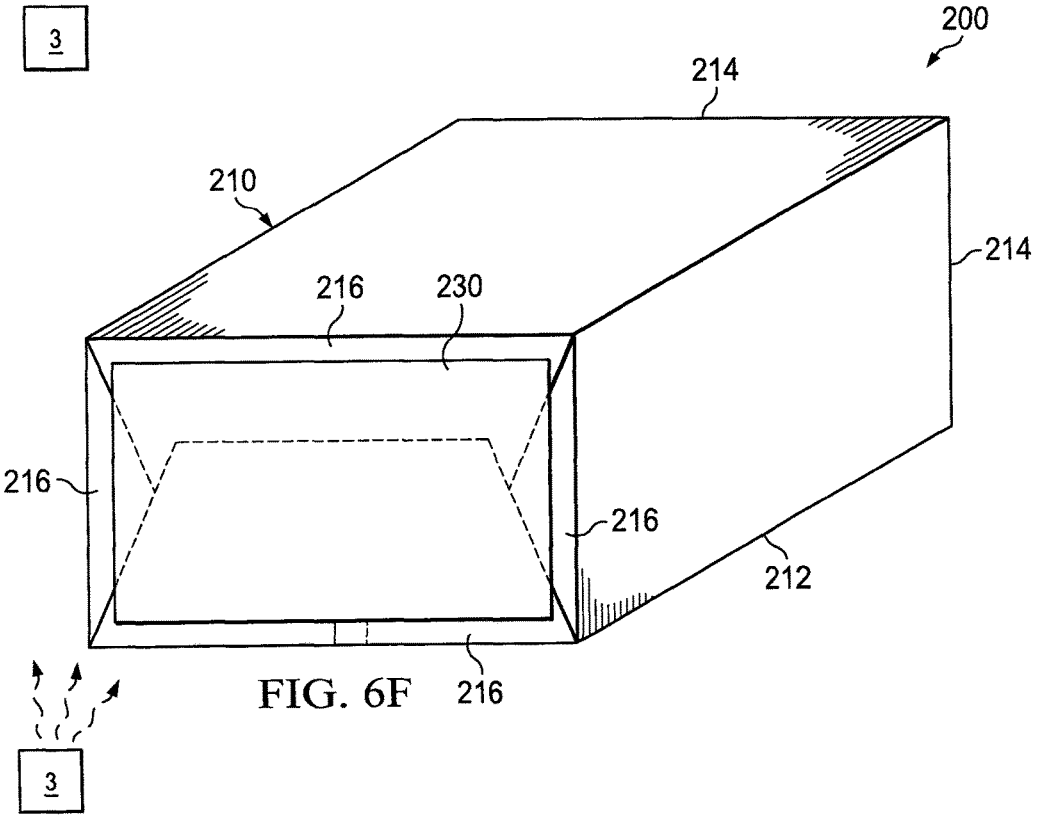
FIG. 6F is a perspective view of securing a patch section to the second end portion of the hybrid-construct bag.
Figure 6G:
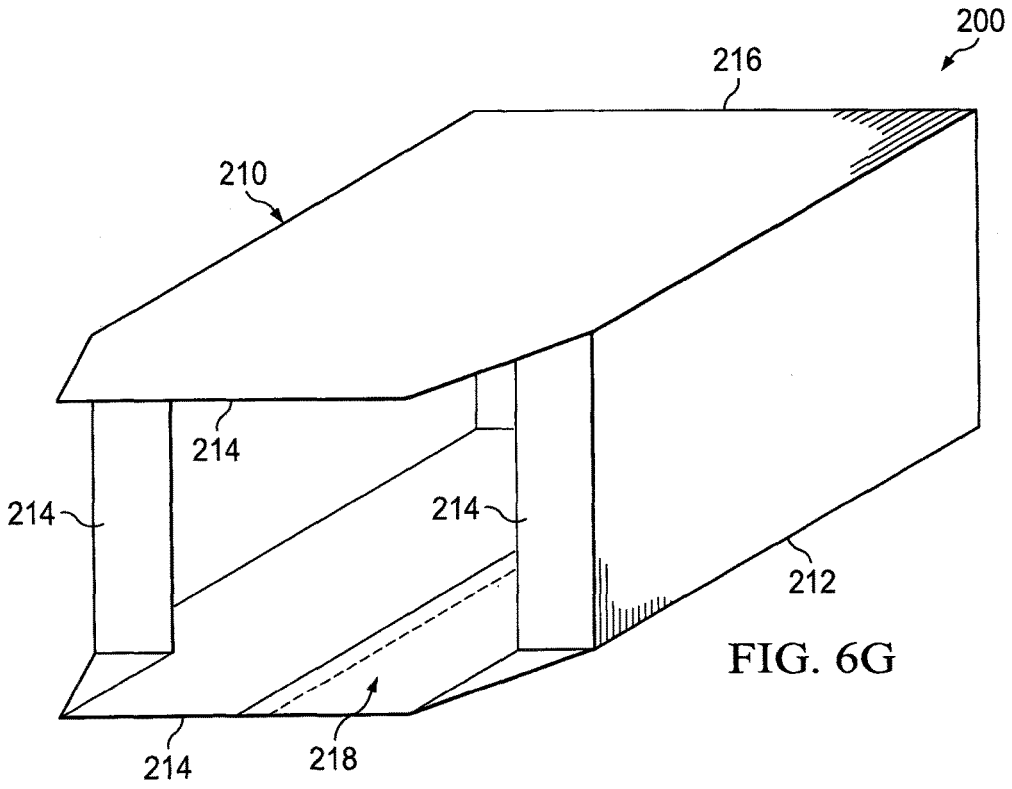
FIG. 6G is a perspective view of forming a first end portion of the hybrid-construct bag.

FIG. 6G illustrates an example embodiment of forming the first end portion 214 (e.g., action 114). The first end portion 214 may be formed by first folding a plurality of portions of a third end (e.g., third end 1*c*) of the first sheet 1, and such folding may be performed in such a way that an outer surface of the first end portion 214 includes the laminate layer of the first sheet 1. The formation of the first end portion 214, as well as the formation of the valve section (e.g., valve section 220), will be further described below in the section "(5) Forming a valve section (e.g., action 120)."

(5) Forming a Valve Section (e.g., Action 120).

Figure 3:
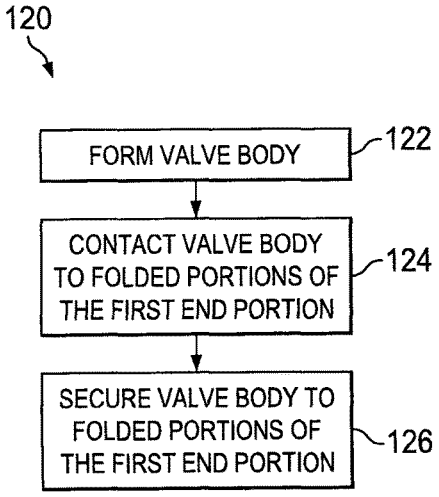
FIG. 3 is an example embodiment of a method for forming an example embodiment of a valve section.
Figure 6H:
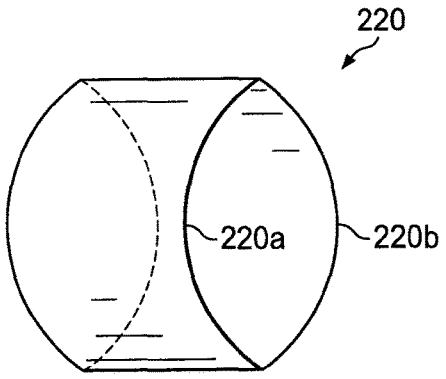
FIG. 6H is a perspective view of an example embodiment of a valve section.
Figure 6I:
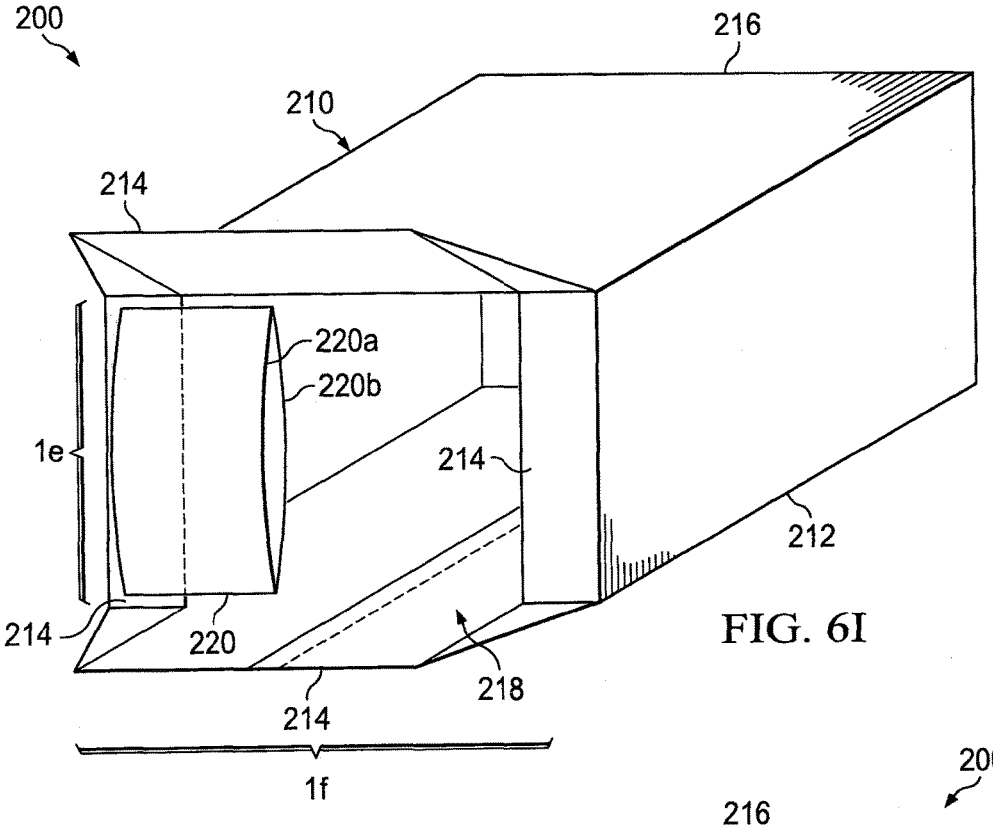
FIG. 6I is a perspective view of providing a valve section with a first end portion of the hybrid-construct bag.
Figure 6J:
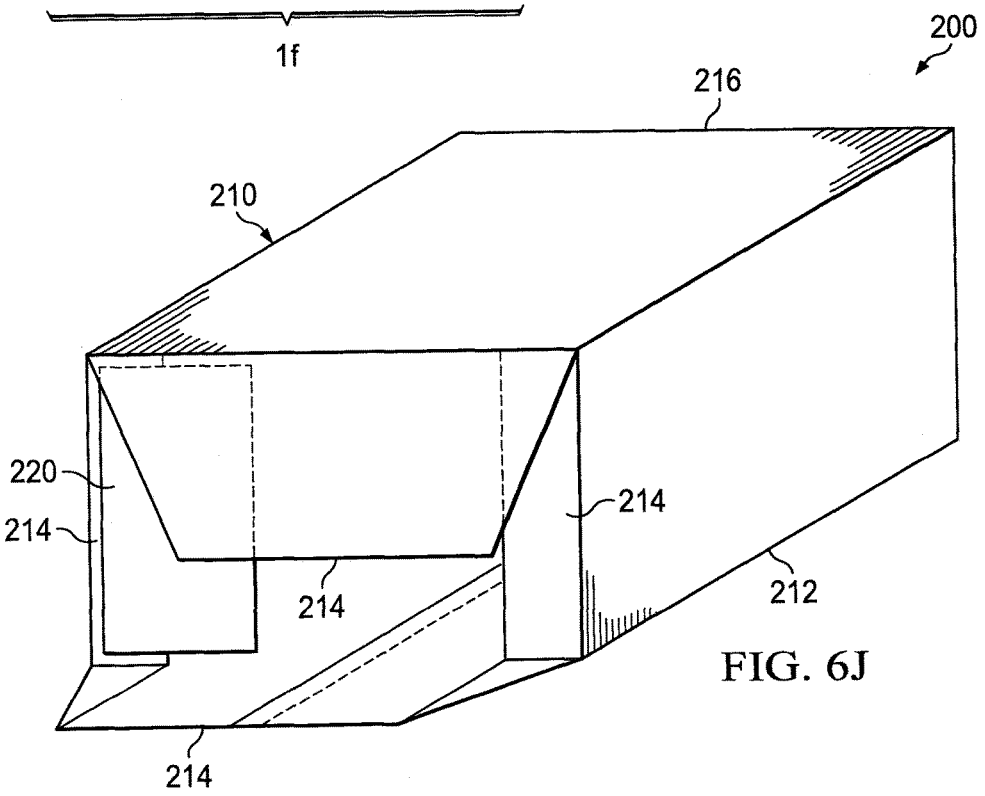
FIG. 6J is another perspective view of forming a first end portion of the hybrid-construct bag along with a valve section.

As illustrated in FIG. 6H and FIG. 3, the valve section (e.g., valve section 220) may be formed (e.g., action 120) by at least a sheet (e.g., second sheet from action 104). As described above, the second sheet may be a fabric-based sheet, such as a laminated or non-laminated woven fabric-based sheet. The second sheet may also be a paper-based sheet or other type of sheet having one or more fabric-based sheets, such as a laminated or non-laminated woven fabric-based sheet, secured on the paper-based sheet. Other configurations of the second sheet are contemplated without departing from the teachings of the present disclosure.

The valve section 220 may include a valve body having a top wall 220*a* and a bottom wall 220*b*. The valve body of the valve section 220 may be formed (e.g., action 122) in such a way that the valve section 220 may be configurable to be substantially tubular in shape, as illustrated in FIG. 6H. Such a configuration enables the valve section 220 to receive a nozzle, tube, or the like for filling contents into the cavity 218 of the bag 200. The valve section 220 may also be configurable to be in a folded position in such a way that the top wall 220*a* is in contact with the bottom wall 220*b*. Such a configuration enables the valve section 220 to prevent contents in the cavity 218 of the bag 200 from passing through the valve section 220.

The top wall 220*a* and/or the bottom wall 220*b* may include and/or be formed by the second sheet (which may be different from the first sheet), as described above and in the present disclosure. In example embodiments wherein the valve section 220 is formed using a single sheet (e.g., second sheet), such as a laminated or non-laminated woven fabric-based sheet, the top wall 220*a* and bottom wall 220*b* will also be formed using the same single sheet. In some example embodiments, the valve section 220 may also be formed using more than one sheet. For example, the valve section 220 may be formed by a single paper-based sheet, such as a laminated paper-based sheet, having a second type of sheet, such as a laminated or non-laminated woven fabric-based sheet, secured to the paper-based sheet in such a way that the top wall 220*a* and bottom wall 220*b* include the second type of sheet.

The valve section 220 may be provided at the first end portion 214, as illustrated in at least FIG. 6I, FIG. 6J, FIG. 6K, and FIG. 6L, in such a way that most or all of the valve body, including the top wall 220*a* and bottom wall 220*b*, are provided (or formed) between folded portions of the first end portion 214. The valve section 220 may then be secured to the first end portion 214 (i.e., the folded portions of the first end portion 214), and such securing may be performed via the laminate layer of the first end portion 214 (and the laminate layer of the valve section 220, if provided).

In an example embodiment, the securing of the valve section 220, including the valve body, top wall 220*a*, and bottom wall 220*b*, to the first end portion 214 may be performed in one or more of a plurality of ways. For example, the securing may be performed by contacting the valve section 220 to the laminate layer of the first end portion 214 (i.e., folded portions of the first end portion 214) (e.g., action 124). The securing may further include creating a bond between or securing of the valve section 220 and the first end portion 214 (e.g., action 126). Such a bond may be effected by applying a first temperature. For example, the first temperature may be applied via heat, hot air, or the like, from an external source 3. The first temperature may be a temperature sufficient to melt, liquefy, activate a component of, and/or cause a change in (such as a change in structure, phase, composition, etc.) the laminate layer of the first end portion 214 (and the laminate layer of the valve section 220 if the second sheet includes a laminate layer). In this regard, it may be said or considered in example embodiments that the valve section 220 is or becomes laminated to the first end portion 214.

The first temperature may be selected based on, among other things, the composition and/or thickness of the laminate layer of the first end portion 214. The first temperature may also be selected based on the composition and/or thickness of the laminate layer of the valve section 220 if the second sheet includes a laminate layer. For example, when one or both of the laminate layers include HDPE, LLDPE, PE woven fabrics, HDPE, LDPE, LLDPE, PP, PE, non-woven fabrics, paper, plastic, film and a thickness of about 15 to 300 microns, the first temperature may be between about 200 to 900 degrees Celsius.

It is recognized in the present disclosure that such a valve section 220 and the securing of such a valve section 220 to the first end portion 214 by creating such a bond (i.e., via the laminate layer of the first end portion 214, and the laminate layer of the valve section 220, if provided) enables the valve section 220 to have a sufficiently strong structure and prevent damage during a content filling process. Furthermore, securing the valve section 220 to the first end portion 214 in this manner may provide for further advantages, including, but not limited to, eliminating the need to use adhesive, or the like, to secure the valve section 220 to the first end portion 214, reduction in process steps, reduction in time required to form the bag 200 (e.g., use of adhesive, or the like, typically requires an extensive period of time for the adhesive to cure, dry, etc.), etc.

Figure 6K:
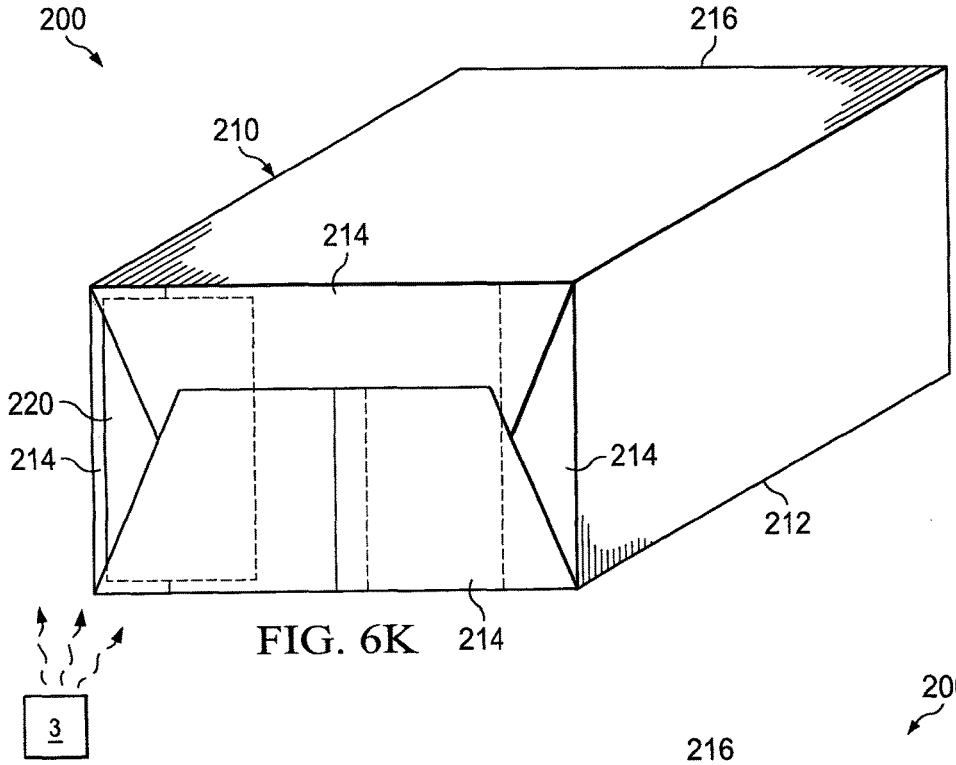
FIG. 6K is another perspective view of forming a first end portion of the hybrid-construct bag along with a valve section.

In an example embodiment, as illustrated in FIG. 6K, the securing of the valve section 220 may be performed in one action or step prior to (or after) the securing of the patch section (e.g., patch section 230) (if provided), such as after the valve section 220 is placed between the folded sections of the first end portion 214 (see FIG. 6K). In example embodiments, the securing of the valve section 220 may also be performed in more than one action or step, such as performing a securing (e.g., applying the first temperature) after each folding action or step of the first end portion 214 (see FIGS. 6I-L). Other sequences and/or, quantities of actions or steps for securing the valve section 220 and patch section 230 (each as applicable) are contemplated without departing from the teachings of the present disclosure.

After the valve section 220 is secured to the first end portion 214 (and the first end portion 214 and second end portion 216 are formed, and if applicable, the patch section 230 is secured to the second end portion 216), the valve section 220 may be configurable to be substantially tubular in shape so as to enable a nozzle, tube, or the like, to be inserted into the valve section 220 for pouring or injecting of contents into the cavity 218 of the bag 200. Furthermore, after the contents are provided into the cavity 218 of the bag 200, the valve section 220 may be configurable to be in a folded position in such a way that the top wall 220*a* of the valve section 220 is in contact with the bottom wall 220*b* of the valve section 220.

(6) Forming a Patch Section (e.g., Action 130).

Patch Section (e.g., Patch Section 230) for the First End Portion (e.g., First End Portion 214).

As illustrated in FIG. 4, example embodiments of the method 100 may further comprise forming a patch section for the first end portion (e.g., action 130, patch section 230, first end portion 214). The patch section 230 may be formed (e.g., action 130) by a sheet (e.g., third sheet from action 106). In an example embodiment, the sheet may be a fabric-based sheet, such as a laminated or non-laminated woven fabric-based sheet. The sheet may also be a paper-based sheet having one or more fabric-based sheets, such as a laminated or non-laminated woven fabric-based sheet, secured on the paper-based sheet. Other configurations of the sheet for use in forming the patch section 230 for the first end portion 214 are contemplated without departing from the teachings of the present disclosure. It is to be understood in the present disclosure that the sheet may be a sheet that is the same as, similar to, or different from the sheet used to form the patch section 230 for the second end portion 216 (as described below and in the present disclosure) and/or the second sheet used to form the valve section 220 (e.g., second sheet from action 104) without departing from the teachings of the present disclosure.

As illustrated in at least FIG. 6E and described above and in the present disclosure, after the first end portion 214 and second end portion 216 are formed, the valve section 220 is provided (if applicable), and the contents are inserted into the cavity 218, the patch section 230 may be provided at and contacted with the first end portion 214 (e.g., action 132). The patch section 230 may then be secured to the first end portion 214 (i.e., the folded portions of the first end portion 214) (e.g., action 134), and such securing may be performed via the laminate layer of the first end portion 214. The securing may also be performed via the laminate layer of the patch section 230 (if provided). This is illustrated in at least FIG. 6L and FIG. 5C.

Figure 6L:
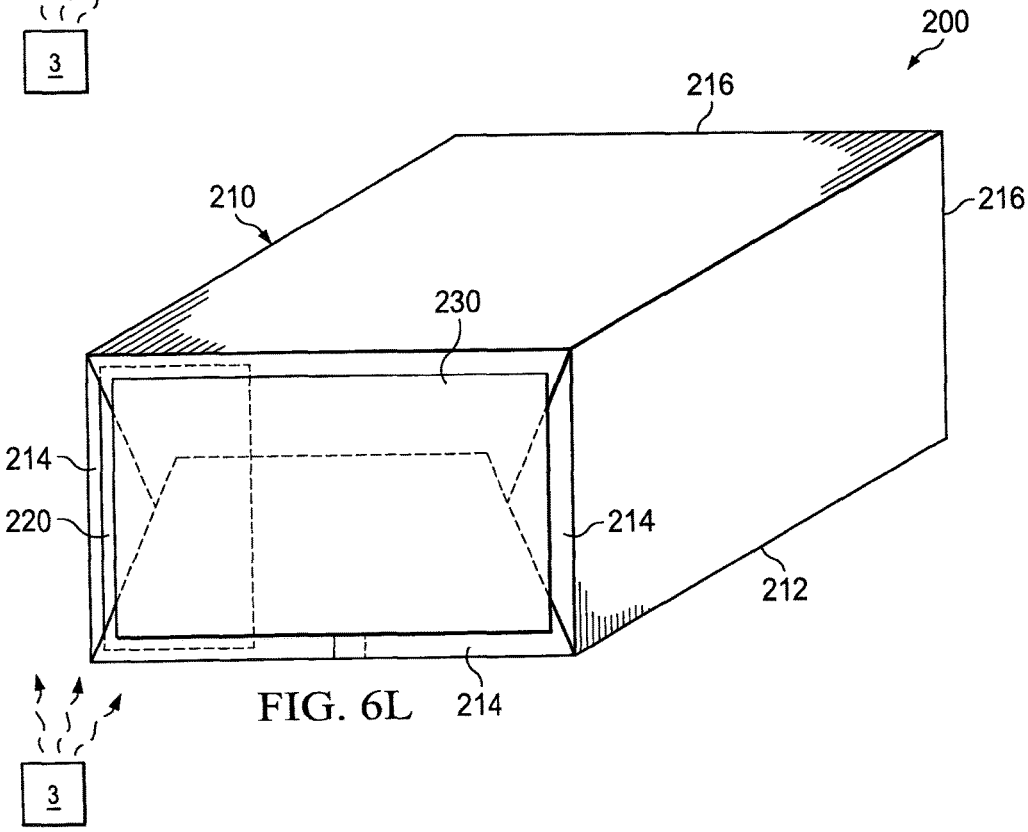
FIG. 6L is a perspective view of securing a patch section to the first end portion and valve section of the hybrid-construct bag.

In an example embodiment, the securing of the patch section 230 to the first end portion 214 may be performed in one or more of a plurality of ways. For example, the securing may be performed by contacting the patch section 230 to the laminate layer of the first end portion 214 (e.g., action 132) and creating a bond between the patch section 230 and the first end portion 214 (e.g., action 134). Such a bond may be effected by applying a temperature, such as the first temperature. For example, as illustrated in FIG. 6L, the first temperature may be applied via heat, hot air, or the like, from an external source 3. The temperature may be a temperature sufficient to melt, liquefy, activate a component of, and/or cause a change (such as a change in structure, phase, composition, etc.) in the laminate layer of the first end portion 214 (and the laminate layer of the patch section 230, if included). In this regard, it may be said or considered in example embodiments that the patch section 230 is or becomes laminated to the first end portion 214.

The temperature may be selected based on, among other things, the composition and/or thickness of the laminate layer of the first end portion 214. The temperature may also be selected based on the composition and/or thickness of the laminate layer of the patch section 230, if included. For example, when one or both of the laminate layers include HDPE, LLDPE, PE woven fabrics, HDPE, LDPE, LLDPE, PP, PE, non-woven fabrics, paper, plastic, and film, and a thickness of about 15 to 200 micron, the temperature may be between about 200 to 900 degrees Celsius.

It is recognized in the present disclosure that securing the patch section 230 to the first end portion 214 by creating such a bond (i.e., via the laminate layer of the first end portion 214, and the laminate layer of the patch section 230, if provided) enables the bag 200 to provide for a sufficiently strong structure. Furthermore, securing the patch section 230 to the first end portion 214 in this manner may provide for further advantages, including, but not limited to, eliminating the need to use adhesive, or the like, to secure the patch section 230 to the first end portion 214, reduction in process steps, reduction in time required to form the bag 200 (e.g., use of adhesive, or the like, typically requires an extensive period of time for the adhesive to cure, dry, etc.), improved prevention of leakage of contents, etc.

After the patch section 230 is secured to the first end portion 214 (and the valve portion 220 is secured to the first end portion 214 and the contents are received in the cavity 218) and another patch section 230 is secured to the second end portion 216 (if applicable, as described below and in the present disclosure), the bag 200 may be ready for shipment.

Patch Section (e.g., Patch Section 230) for the Second End Portion (e.g., Second End Portion 216).

Example embodiments of the method 100 may further comprise forming a patch section for the second end portion (e.g., action 130, patch section 230, second end portion 216). The patch section 230 may be formed (e.g., action 130) by a sheet (e.g., third sheet from action 106 or a fourth sheet). In an example embodiment, the sheet may be a fabric-based sheet, such as a laminated or non-laminated woven fabric-based sheet. The sheet may also be a paper-based sheet having one or more fabric-based sheets, such as a laminated or non-laminated woven fabric-based sheet, secured on the paper-based sheet. Other configurations of the sheet for use in forming the patch section 230 for the second end portion 216 are contemplated without departing from the teachings of the present disclosure. It is to be understood in the present disclosure that the sheet may be a sheet that is the same as, similar to, or different from the sheet used to form the patch section 230 for the first end portion 214 (as described above and in the present disclosure) and/or the second sheet used to form the valve section 220 (e.g., second sheet from action 104) without departing from the teachings of the present disclosure.

As illustrated in at least FIG. 6E and described above and in the present disclosure, after the second end portion 216 is formed by folding the plurality of portions of the fourth end 1d of the first sheet 1, the patch section 230 may be provided at and contacted with the second end portion 216 (e.g., action 132). The patch section 230 may then be secured to the second end portion 216 (i.e., the folded portions of the second end portion 216) (e.g., action 134), and such securing may be performed via the laminate layer of the second end portion 216. The securing may also be performed via the laminate layer of the patch section 230 (if provided). This is illustrated in at least FIG. 6F and FIG. 5C.

In an example embodiment, the securing of the patch section 230 to the second end portion 216 may be performed in one or more of a plurality of ways. For example, the securing may be performed by contacting the patch section 230 to the laminate layer of the second end portion 216 (e.g., action 132) and creating a bond between the patch section 230 and the second end portion 216 (e.g., action 134). Such a bond may be effected by applying a temperature, such as the first temperature. For example, as illustrated in FIG. 6F, the first temperature may be applied via heat, hot air, or the like, from an external source 3. The temperature may be a temperature sufficient to melt, liquefy, activate a component of, and/or cause a change (such as a change in structure, phase, composition, etc.) in the laminate layer of the second end portion 216 (and the laminate layer of the patch section 230, if included). In this regard, it may be said or considered in example embodiments that the patch section 230 is or becomes laminated to the second end portion 216.

The temperature may be selected based on, among other things, the composition and/or thickness of the laminate layer of the second end portion 216. The temperature may also be selected based on the composition and/or thickness of the laminate layer of the patch section 230, if included. For example, when one or both of the laminate layers include HDPE, LLDPE, PE woven fabrics, HDPE, LDPE, LLDPE, PP, PE, non woven fabrics, paper, plastic, and film, and a thickness of about 15 to 200 micron, the temperature may be between about 200 to 900 degrees Celsius.

It is recognized in the present disclosure that securing the patch section 230 to the second end portion 216 by creating such a bond (i.e., via the laminate layer of the second end portion 216, and the laminate layer of the patch section 230, if provided) enables the bag 200 to provide for a sufficiently strong structure. Furthermore, securing the patch section 230 to the second end portion 216 in this manner may provide for further advantages, including, but not limited to, eliminating the need to use adhesive, or the like, to secure the patch section 230 to the second end portion 216, reduction in process steps, reduction in time required to form the bag 200 (e.g., use of adhesive, or the like, typically requires an extensive period of time for the adhesive to cure, dry, etc.), improved prevention of leakage of contents, etc.

After the patch section 230 is secured to the second end portion 216 and the first end portion 214 and valve section 220 are formed, the bag 200 may be ready to receive a nozzle, tube, or the like, to be inserted into the valve section 220 for pouring or injecting of contents into the cavity 218 of the bag 200.

Example Embodiment of a Hybrid-construct Bag (e.g., Bag 200)

Example embodiments of a hybrid-construct bag (e.g., bag 200), including those illustrated in FIGS. 5A-C, 6F, and 6L, will be further described below.

Hybrid-construct Bag (e.g., Bag 200) Having a Bag Body (e.g., Bag Body 210) and a Valve Section (e.g., Valve Section 220).

An example embodiment of the bag 200 may include a bag body (e.g., bag body 210) having a first end portion (e.g., first end portion 214), second end portion (e.g., second end portion 216), and main body portion (e.g., main body portion 212). The main body portion 212, first end portion 214, and second end portion 216 may cooperatively form a cavity 218 operable to receive contents. The bag 200 may further include a valve section (e.g., valve section 220).

In respect to the bag body 210, the bag body 210 may be formed by at least a first sheet 1. The first sheet 1 may be a paper-based sheet having a laminate layer formed over at least a portion of the paper-based sheet. The main body portion 212 may be formed by securing a first end 1*a* of the first sheet 1 to a second end 1*b* of the first sheet 1 in such a way that an outer surface of the main body portion 212 includes the laminate layer.

The bag body 210 may include a first end portion 214. The first end portion 214 may be formed by folding a plurality of portions of a third end 1*c* of the first sheet 1 in such a way that an outer surface of the first end portion 214 includes the laminate layer.

The bag body 210 may further include a second end portion 216 opposite to the first end portion 214. The second end portion 216 may be formed by folding a plurality of portions of a fourth end 1*d* of the first sheet 1 in such a way that an outer surface of the second end portion 216 includes the laminate layer.

At least a portion of the first sheet 1 forming the main body portion 212 may include a plurality of perforations. Each of the perforations may be operable to allow a gas to pass through. Furthermore, each of the perforations may be operable to resist a liquid from passing through. A density of the perforations may be between about 5 to 256 perforations/$cm^2$.

The bag body 210 may further include one or more other sheets stacked along with the first sheet 1. The one or more other sheets may be formed between the first sheet 1 and the cavity 218. The first sheet 1 may include a polypropylene layer. Furthermore, the first sheet 1 may include bi-axially oriented polypropylene, HDPE, LLDPE, PE woven fabrics, HDPE, LDPE, LLDPE, PP, PE, non-woven fabrics, paper, plastic, film, etc. In respect to the valve section 220, the valve section 220 may be formed at the first end portion 214. The valve section 220 may include a top wall 220*a* and a bottom wall 220*b* formed between folded portions of the first end portion 214. The valve section 220 may be configurable to be substantially tubular in shape in such a way as to form a channel between the top 220*a* and bottom 220*b* walls. When the valve section 220 is configured to form the channel between the top 220*a* and bottom 220*b* walls, the valve section 220 may be operable to enable contents to be received into the cavity 218. The valve section 220 may also be configurable to be in a folded position in such a way that the top wall 220*a* is in contact with the bottom wall 220*b*.

At least one of the top wall 220*a* and bottom wall 220*b* may be formed by a second sheet different from the first sheet 1. The second sheet may be a fabric-based sheet. The fabric-based sheet of the valve section 220 may include woven polypropylene, HDPE, LLDPE, PE woven fabrics, HDPE, LDPE, LLDPE, PP, PE, non-woven fabrics, paper, plastic, film, etc. The bag 200 may include a laminate layer formed over the fabric-based sheet of the valve section 220.

The valve section 220 may be secured to the first end portion 214 via the laminate layer of the first end portion 214. In an example embodiment, the top wall 220*a* and/or bottom wall 220*b* of the valve section 220 formed by the second sheet may be secured to the first end portion 214 by laminating the laminate layer of the first end portion 214 to the said top wall 220*a* and/or bottom wall 220*b*.

In another example embodiment, the top wall 220*a* and/or bottom wall 220*b* of the valve section 220 formed by the second sheet may be secured to the first end portion 214 by contacting the said second sheet to the laminate layer of the first end portion 214 and creating a bond between the said second sheet and the first end portion 214 by applying a first temperature.

In another example embodiment, the top wall 220*a* and/or bottom wall 220*b* of the valve section 220 formed by the second sheet may be secured to the first end portion 214 by contacting a laminate layer formed over the fabric-based sheet of the valve section 220 to the laminate layer of the first end portion 214 and creating a bond between the second sheet and the first end portion 214 by applying a first temperature.

Hybrid-construct Bag (e.g., Bag 200) Having a Bag Body (e.g., Bag Body 210) and a Patch Section (e.g., Patch Section 230).

In another example embodiment, the bag 200 may include a bag body (e.g., bag body 210) having a first end portion (e.g., first end portion 214), second end portion (e.g., second end portion 216), and main body portion (e.g., main body portion 212). The main body portion 212, first end portion 214, and second end portion 216 may cooperatively form a cavity 218 operable to receive contents. The bag 200 may also include one or more patch sections (e.g., patch section 230 formed in the first end portion 214 and/or patch section 230 formed in the second end portion 216).

In respect to the bag body 210, the bag body 210 may be formed by at least a first sheet 1. The first sheet 1 may be a paper-based sheet having a laminate layer formed over at least a portion of the paper-based sheet. The bag body 210 may include a substantially tubular main body portion 212 formed by securing a first end 1*a* of the first sheet 1 to a second end 1*b* of the first sheet 1 in such a way that an outer surface of the main body portion 212 includes the laminate layer.

The bag body 210 may include a first end portion 214. The first end portion 214 may be formed by folding a plurality of portions of a third end 1*c* of the first sheet 1 in such a way that an outer surface of the first end portion 214 includes the laminate layer.

The bag 200 may further include a second end portion 216 opposite to the first end portion 214. The second end portion 216 may be formed by folding a plurality of portions of a fourth end 1*d* of the first sheet 1 in such a way that an outer surface of the second end portion 216 includes the laminate layer.

At least a portion of the first sheet 1 forming the main body portion 210 may include a plurality of perforations. Each of the perforations may be operable to allow a gas to pass through. Furthermore, each of the perforations may be operable to resist a liquid from passing through. A density of the perforations may be between about 5 to 256 perforations/$cm^2$.

The bag body 210 may further comprise one or more other sheets stacked along with the first sheet 1. The one or more other sheets may be formed between the first sheet 1 and the cavity 218. The first sheet 1 may include a polypropylene layer. The first sheet 1 may further include bi-axially oriented polypropylene, HDPE, LLDPE, PE woven fabrics, HDPE, LDPE, LLDPE, PP, PE, non-woven fabrics, paper, plastic, film, etc.

In respect to the patch section 230, the patch section 230 may be formed by at least a second sheet different from the first sheet 1. The second sheet may be a fabric-based sheet. The fabric-based sheet of the patch section 230 may include woven polypropylene, HDPE, LLDPE, PE woven fabrics, HDPE, LDPE, LLDPE, PP, PE, non-woven fabrics, paper, plastic, film, etc. The bag 200 may further include a laminate layer formed over the fabric-based sheet of the patch section 230. The patch section 230 may be secured to the first end portion 214 via the laminate layer of the first end portion 214. In an example embodiment, the patch section 230 may be secured to the first end portion 214 by laminating the laminate layer of the first end portion 214 to the patch section 230.

In another example embodiment, the patch section 230 may be secured to the first end portion 214 by contacting the patch section 230 to the laminate layer of the first end portion 214 and creating a bond between the patch section 230 and the first end portion 214 by applying a first temperature.

In another example embodiment, the patch section 230 may be secured to the first end portion 214 by contacting a laminate layer formed over the fabric-based sheet of the patch section 230 to the laminate layer of the first end portion 214 and creating a bond between the patch section 230 and the first end portion 214 by applying a first temperature.

The bag 200 may further comprise a second patch section 230. The second patch section 230 may be formed by at least a third sheet different from the first sheet 1. The third sheet may be a fabric-based sheet. The second patch section 230 may be secured to the second end portion 216 via the laminate layer of the second end portion 216. The second patch section 230 may be similar to or substantially the same as the first patch section 230 of the first end portion 214.

A size of the patch section 230 may be selected based on a size of the first end portion 214 (and second end portion 216 for the second patch section 230).

Hybrid-construct Bag (e.g., Bag 200) Having a Bag Body (e.g., Bag Body 210), a Valve Section (e.g., Valve Section 220), and One or More Patch Sections (e.g., Patch Section(s) 230).

In another example embodiment, the bag 200 may include a bag body (e.g., bag body 210) having a first end portion (e.g., first end portion 214), second end portion (e.g., second end portion 216), and main body portion (e.g., main body portion 212). The main body portion 212, first end portion 214, and second end portion 216 may cooperatively form a cavity 218 operable to receive contents. The bag 200 may further include a valve section (e.g., valve section 220) and one or more patch sections (e.g., patch section 230 formed in the first end portion 214 and/or patch section 230 formed in the second end portion 216).

In respect to the bag body 210, the bag body 210 may be formed by at least a first sheet 1. The first sheet 1 may be a paper-based sheet having a laminate layer formed over at least a portion of the paper-based sheet. The bag body 210 may include a substantially tubular main body portion 212 formed by securing a first end 1*a* of the first sheet 1 to a second end 1*b* of the first sheet 1 in such a way that an outer surface of the main body portion 212 includes the laminate layer.

The bag body 210 may also include a first end portion 214 formed by folding a plurality of portions of a third end 1*c* of the first sheet 1 in such a way that an outer surface of the first end portion 214 includes the laminate layer.

The bag body 210 may also include a second end portion 216 opposite to the first end portion 214. The second end portion 216 may be formed by folding a plurality of portions of a fourth end 1*d* of the first sheet 1 in such a way that an outer surface of the second end portion 216 includes the laminate layer.

At least a portion of the first sheet 1 forming the main body portion 212 may include a plurality of perforations. Each of the perforations may be operable to allow a gas to pass through. Furthermore, each of the perforations may be operable to resist a liquid from passing through. A density of the perforations may be between about 5 and 256 perforations/$cm^2$.

The bag body 210 may further comprise one or more other sheets stacked along with the first sheet 1. The one or more other sheets may be formed between the first sheet 1 and the cavity 218. The first sheet 1 may include a polypropylene layer. The first sheet 1 may include bi-axially oriented polypropylene.

In respect to the valve section 220, the valve section 220 may be formed at the first end portion 214. The valve section 220 may include a top wall 220*a* and a bottom wall 220*b* formed between folded portions of the first end portion 214. The valve section 220 may be configurable to be substantially tubular in shape in such a way as to form a channel between the top 220*a* and bottom 220*b* walls. When the valve section 220 is configured to form the channel between the top 220*a* and bottom 220*b* walls, the valve section 220 may be operable to enable contents to be received into the cavity 218. The valve section 220 may also be configurable to be in a folded position in such a way that the top wall 220*a* is in contact with the bottom wall 220*b*.

At least one of the top wall 220*a* and bottom wall 220*b* may be formed by a second sheet different from the first sheet 1. The second sheet may be a fabric-based sheet. The fabric-based sheet of the valve section 220 may include woven polypropylene. The bag 200 may further include a laminate layer formed over the fabric-based sheet of the valve section 220. The valve section 220 may be secured to the first end portion 214 via the laminate layer of the first end portion 214. In an example embodiment, the top wall 220*a* and/or bottom wall 220*b* of the valve section 220 formed by the second sheet may be secured to the first end portion 214 by laminating the laminate layer of the first end portion 214 to the said top wall 220*a* and/or bottom wall 220*b*.

In another example embodiment, the top wall 220*a* and/or bottom wall 220*b* of the valve section 220 formed by the second sheet may be secured to the first end portion 214 by contacting the said second sheet to the laminate layer of the first end portion 214 and creating a bond between the said second sheet and the first end portion 214 by applying a first temperature.

In another example embodiment, the top wall 220*a* and/or bottom wall 220*b* of the valve section 220 formed by the second sheet may be secured to the first end portion 214 by contacting a laminate layer formed over the fabric-based sheet of the valve section 220 to the laminate layer of the first end portion 214 and creating a bond between the second sheet and the first end portion 214 by applying a first temperature.

In respect to the patch section 230, the patch section 230 may be formed by at least a third sheet different from the first sheet 1. The third sheet may be a fabric-based sheet. The fabric-based sheet of the patch section may include woven polypropylene, woven polyethylene. The bag 200 may further include a laminate layer formed over the fabric-based sheet of the patch section 230. The patch section 230 may be secured to the first end portion 214 via the laminate layer of the first end portion 214. In an example embodiment, the patch section 230 may be secured to the first end portion 214 by laminating the laminate layer of the first end portion 214 to the patch section 230.

In another example embodiment, the patch section 230 may secured to the first end portion 214 by contacting the patch section 230 to the laminate layer of the first end portion 214 and creating a bond between the patch section 230 and the first end portion 214 by applying a first temperature.

In another example embodiment, the patch section 230 may be secured to the first end portion 214 by contacting a laminate layer formed over the fabric-based sheet of the patch section 230 to the laminate layer of the first end portion 214 and creating a bond between the patch section 230 and the first end portion 214 by applying a first temperature.

A size of the patch section 230 may be selected based on a size of the first end portion 214.

The bag 200 may further include a second patch section 230. The second patch section 230 may be formed by at least a fourth sheet different from the first sheet 1. The fourth sheet may be a fabric-based sheet. The second patch section 230 may be secured to the second end portion 216 via the laminate layer of the second end portion 216. A composition of the second sheet may be substantially the same as a composition of the third sheet.

While various embodiments in accordance with the disclosed principles have been described above, it should be understood that they have been presented by way of example only, and are not limiting. Thus, the breadth and scope of the example embodiments described in the present disclosure should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

For example, "assembly," "apparatus," "portion," "segment," "member," "body," "section," "subsystem," "system," or other similar terms should generally be construed broadly to include one part or more than one part attached or connected together.

Various terms used herein have special meanings within the present technical field. Whether a particular term should be construed as such a "term of art" depends on the context in which that term is used. For example, "connect," "connected," "connecting," "connectable," "attach," "attached," "attaching," "attachable," "secure," "secured," "securing," "securable," "lock," "locked," "locking," "lockable," "anchor," "anchored," "anchoring," "anchorable," "install," "installed," "installing," "installable," "couple," "coupled," "coupling," "in communication with," "communicating with," "associated with," "associating with," or other similar terms should generally be construed broadly to include situations where attachments, connections, installations, and anchoring are direct between referenced elements or through one or more intermediaries between the referenced elements. As another example, "un-connect," "un-connected," "un-connecting," "un-connectable," "un-attach," "un-attached," "un-attaching," "un-attachable," "un-secure," "un-secured," "un-securing," "un-securable," "unlock," "unlocked," "unlocking," "unlockable," "un-anchor," "un-anchored," "un-anchoring," "un-anchorable," "uninstall," "uninstalled," "uninstalling," "uninstallable," "uncouple," "uncoupled," "uncoupling," or other similar terms should generally be construed broadly to include situations where separation, removal, and detaching are direct between referenced elements or from one or more intermediaries between the referenced elements. These and other terms are to be construed in light of the context in which they are used in the present disclosure and as one of ordinary skill in the art would understand those terms in the disclosed context. The above definitions are not exclusive of other meanings that might be imparted to those terms based on the disclosed context.

Words of comparison, measurement, and timing such as "at the time," "equivalent," "during," "complete," and the like should be understood to mean "substantially at the time," "substantially equivalent," "substantially during," "substantially complete," etc., where "substantially" means that such comparisons, measurements, and timings are practicable to accomplish the implicitly or expressly stated desired result.

Additionally, the section headings and topic headings herein are provided for consistency with the suggestions under various patent regulations and practice, or otherwise to provide organizational cues. These headings shall not limit or characterize the embodiments set out in any claims that may issue from this disclosure. Specifically, a description of a technology in the "Background" is not to be construed as an admission that technology is prior art to any embodiments in this disclosure. Furthermore, any reference in this disclosure to "invention" in the singular should not be used to argue that there is only a single point of novelty in this disclosure. Multiple inventions may be set forth according to the limitations of the claims issuing from this disclosure, and such claims accordingly define the invention(s), and their equivalents, that are protected thereby. In all instances, the scope of such claims shall be considered on their own merits in light of this disclosure, but should not be constrained by the headings herein.

What is claimed is:

1. A hybrid-construct bag comprising:

a bag body formed by at least a first sheet, the first sheet being a paper-based sheet having a laminate layer formed over at least a portion of the paper-based sheet, the bag body having:

a substantially tubular main body portion formed by securing a first end of the first sheet to a second end of the first sheet in such a way that an outer surface of the main body portion includes the laminate layer;

a first end portion formed by folding a plurality of portions of a third end of the first sheet in such a way that an outer surface of the first end portion includes the laminate layer; and a second end portion opposite to the first end portion, the second end portion formed by folding a plurality of portions of a fourth end of the first sheet in such a way that an outer surface of the second end portion includes the laminate layer;

a valve section formed at the first end portion, the valve section including a top wall and a bottom wall formed between folded portions of the first end portion, wherein the valve section is configurable to be substantially tubular in shape in such a way as to form a channel between the top and bottom walls and configurable to be in a folded position in such a way that the top wall is in contact with the bottom wall, wherein at least one of the top wall and bottom wall are formed by a second sheet different from the first sheet, wherein the second sheet is a fabric-based sheet, wherein the valve section is secured to the first end portion via the laminate layer of the first end portion, and wherein the fabric-based sheet of the valve section includes woven polypropylene; and a patch section, the patch section formed by at least a third sheet different from the first sheet, the third sheet being a fabric-based sheet, the patch section secured to the first end portion via the laminate layer of the first end portion, wherein the fabric-based sheet of the patch section includes woven polypropylene;

wherein the main body portion, first end portion, and second end portion cooperatively form a cavity, the cavity operable to receive contents;

wherein, when the valve section is configured to form the channel between the top and bottom walls, the valve section is operable to enable contents to be received into the cavity;

wherein at least a portion of the first sheet forming the main body portion includes a plurality of perforations;

wherein each of the perforations are operable to allow a gas to pass through; and wherein each of the perforations are operable to resist a liquid and/or particulates from passing through.

2. The hybrid-construct bag of claim 1, wherein the bag body further comprises one or more other sheets stacked along with the first sheet, the one or more other sheets formed between the first sheet and the cavity.

3. The hybrid-construct bag of claim 1, further comprising:

a laminate layer formed over the fabric-based sheet of the valve section; and a laminate layer formed over the fabric-based sheet of the patch section.

4. The hybrid-construct bag of claim 1, wherein the top wall and/or bottom wall of the valve section formed by the second sheet is/are secured to the first end portion by laminating the laminate layer of the first end portion to the said top wall and/or bottom wall; and wherein the patch section is secured to the first end portion by laminating the laminate layer of the first end portion to the patch section.

5. The hybrid-construct bag of claim 1, wherein a size of the patch section is selected based on a size of the first end portion.

6. The hybrid-construct bag of claim 1, wherein the top wall and the bottom wall of the valve section are formed by the second sheet.

7. The hybrid-construct bag of claim 1, further comprising a second patch section, the second patch section formed by at least a fourth sheet different from the first sheet, the fourth sheet being a fabric-based sheet, the second patch section secured to the second end portion via the laminate layer of the second end portion.

8. The hybrid-construct bag of claim 1, wherein a composition of the second sheet is substantially the same as a composition of the third sheet.

9. The hybrid-construct bag of claim 1, wherein a density of the perforations is between about 11 to 128 perforations/$cm^2$.

10. A hybrid-construct bag comprising:

a bag body formed by at least a first sheet, the first sheet being a paper-based sheet having a laminate layer formed over at least a portion of the paper-based sheet, the bag body having:

a substantially tubular main body portion formed by securing a first end of the first sheet to a second end of the first sheet in such a way that an outer surface of the main body portion includes the laminate layer;

a first end portion formed by folding a plurality of portions of a third end of the first sheet in such a way that an outer surface of the first end portion includes the laminate layer; and a second end portion opposite to the first end portion, the second end portion formed by folding a plurality of portions of a fourth end of the first sheet in such a way that an outer surface of the second end portion includes the laminate layer;

a valve section formed at the first end portion, the valve section including a top wall and a bottom wall formed between folded portions of the first end portion, wherein the valve section is configurable to be substantially tubular in shape in such a way as to form a channel between the top and bottom walls and configurable to be in a folded position in such a way that the top wall is in contact with the bottom wall, wherein at least one of the top wall and bottom wall are formed by a second sheet different from the first sheet, wherein the second sheet is a fabric-based sheet, and wherein the valve section is secured to the first end portion via the laminate layer of the first end portion; and a patch section, the patch section formed by at least a third sheet different from the first sheet, the third sheet being a fabric-based sheet, the patch section secured to the first end portion via the laminate layer of the first end portion;

wherein the main body portion, first end portion, and second end portion cooperatively form a cavity, the cavity operable to receive contents;

wherein, when the valve section is configured to form the channel between the top and bottom walls, the valve section is operable to enable contents to be received into the cavity;

wherein the top wall and/or bottom wall of the valve section formed by the second sheet is/are secured to the first end portion by:

contacting the said second sheet to the laminate layer of the first end portion; and creating a bond between the said second sheet and the first end portion by applying a first temperature; and wherein the patch section is secured to the first end portion by:

contacting the patch section to the laminate layer of the first end portion; and creating a bond between the patch section and the first end portion by applying a first temperature wherein at least a portion of the first sheet forming the main body portion includes a plurality of perforations;

wherein each of the perforations are operable to allow a gas to pass through; and wherein each of the perforations are operable to resist a liquid and/or particulates from passing through.

11. A hybrid-construct bag comprising:

a bag body formed by at least a first sheet, the first sheet being a paper-based sheet having a laminate layer formed over at least a portion of the paper-based sheet, the bag body having:

a substantially tubular main body portion formed by securing a first end of the first sheet to a second end of the first sheet in such a way that an outer surface of the main body portion includes the laminate layer;

a first end portion formed by folding a plurality of portions of a third end of the first sheet in such a way that an outer surface of the first end portion includes the laminate layer; and a second end portion opposite to the first end portion, the second end portion formed by folding a plurality of portions of a fourth end of the first sheet in such a way that an outer surface of the second end portion includes the laminate layer;

a valve section formed at the first end portion, the valve section including a top wall and a bottom wall formed between folded portions of the first end portion, wherein the valve section is configurable to be substantially tubular in shape in such a way as to form a channel between the top and bottom walls and configurable to be in a folded position in such a way that the top wall is in contact with the bottom wall, wherein at least one of the top wall and bottom wall are formed by a second sheet different from the first sheet, wherein the second sheet is a fabric-based sheet, and wherein the valve section is secured to the first end portion via the laminate layer of the first end portion; and a patch section, the patch section formed by at least a third sheet different from the first sheet, the third sheet being a fabric-based sheet, the patch section secured to the first end portion via the laminate layer of the first end portion;

wherein the main body portion, first end portion, and second end portion cooperatively form a cavity, the cavity operable to receive contents;

wherein, when the valve section is configured to form the channel between the top and bottom walls, the valve section is operable to enable contents to be received into the cavity;

wherein the top wall and/or bottom wall of the valve section formed by the second sheet is/are secured to the first end portion by:

contacting a laminate layer formed over the fabric-based sheet of the valve section to the laminate layer of the first end portion; and creating a bond between the second sheet and the first end portion by applying a first temperature; and wherein the patch section is secured to the first end portion by:

contacting a laminate layer formed over the fabric-based sheet of the patch section to the laminate layer of the first end portion; and creating a bond between the patch section and the first end portion by applying a first temperature wherein at least a portion of the first sheet forming the main body portion includes a plurality of perforations;

wherein each of the perforations are operable to allow a gas to pass through; and wherein each of the perforations are operable to resist a liquid and/or particulates from passing through.

12. A hybrid-construct bag comprising:

a bag body formed by at least a first sheet, the first sheet being a paper-based sheet having a laminate layer formed over at least a portion of the paper-based sheet, the bag body having:

a substantially tubular main body portion formed by securing a first end of the first sheet to a second end of the first sheet in such a way that an outer surface of the main body portion includes the laminate layer;

a first end portion formed by folding a plurality of portions of a third end of the first sheet in such a way that an outer surface of the first end portion includes the laminate layer; and a second end portion opposite to the first end portion, the second end portion formed by folding a plurality of portions of a fourth end of the first sheet in such a way that an outer surface of the second end portion includes the laminate layer; and a valve section formed at the first end portion, the valve section including a top wall and a bottom wall formed between folded portions of the first end portion, wherein the valve section is configurable to be substantially tubular in shape in such a way as to form a channel between the top and bottom walls and configurable to be in a folded position in such a way that the top wall is in contact with the bottom wall, wherein at least one of the top wall and bottom wall are formed by a second sheet different from the first sheet, wherein the second sheet is a fabric based sheet, and wherein the valve section is secured to the first end portion via the laminate layer of the first end portion;

wherein the main body portion, first end portion, and second end portion cooperatively form a cavity, the cavity operable to receive contents;

wherein, when the valve section is configured to form the channel between the top and bottom walls, the valve section is operable to enable contents to be received into the cavity; wherein at least a portion of the first sheet forming the main body portion includes a plurality of perforations;

wherein the top wall and/or bottom wall of the valve section formed by the second sheet is/are secured to the first end portion by:

contacting the said second sheet to the laminate layer of the first end portion; and creating a bond between the said second sheet and the first end portion by applying a first temperature;

wherein each of the perforations are operable to allow a gas to pass through; and wherein each of the perforations are operable to resist a liquid and/or particulates from passing through.

13. The hybrid-construct bag of claim 12, wherein the bag body further comprises one or more other sheets stacked along with the first sheet, the one or more other sheets formed between the first sheet and the cavity.

14. The hybrid-construct bag of claim 12, wherein the first sheet includes a polypropylene layer.

15. The hybrid-construct bag of claim 12, further comprising a laminate layer formed over the fabric-based sheet of the valve section.

16. The hybrid-construct bag of claim 15, wherein the top wall and/or bottom wall of the valve section formed by the second sheet is/are secured to the first end portion by:

contacting the laminate layer formed over the fabric-based sheet of the valve section the laminate layer of the first end portion; and creating a bond between the second sheet and the first end portion by applying a first temperature.

17. The hybrid-construct bag of claim 12, wherein the top wall and/or bottom wall of the valve section formed by the second sheet is/are secured to the first end portion by laminating the laminate layer of the first end portion to the said top wall and/or bottom wall.

18. The hybrid-construct bag of claim 12, wherein the top wall and the bottom wall of the valve section are formed by the second sheet.

19. The hybrid-construct bag of claim 12, wherein a density of the perforations is between about 11 to 128 perforations/$cm^2$.

20. A method of forming a hybrid-construct bag, the method comprising:

providing a first sheet, the first sheet being a paper-based sheet having a laminate layer formed over at least a portion of the paper-based sheet, wherein the first sheet includes a first end, a second end opposite to the first end, a third end, and a fourth end opposite to the third end;

providing a second sheet different from the first sheet, the second sheet being a fabric-based sheet;

providing a third sheet different from the first sheet, the third sheet being a fabric-based sheet;

forming a bag body by:

forming a substantially tubular main body portion by securing the first end of the first sheet to the second end of the first sheet in such a way that an outer surface of the main body portion includes the laminate layer;

forming a first end portion by folding a plurality of portions of the third end of the first sheet in such a way that an outer surface of the first end portion includes the laminate layer; and forming a second end portion by folding a plurality of portions of the fourth end of the first sheet in such a way that an outer surface of the second end portion includes the laminate layer;

forming a valve section by:

forming a substantially tubular valve body using the second sheet;

contacting a first portion of the valve body to a first folded portion of the first end portion;

contacting a second portion of the valve body to a second folded portion of the first end portion, wherein the second portion of the valve body is opposite to the first portion of the valve body, and wherein the second folded portion of the first end portion faces the first folded portion of the first end portion; and applying a first temperature to the first end portion to:

create a bond between the first portion of the valve body and the first folded portion of the first end portion; and create a bond between the second portion of the valve body and the second folded portion of the first end portion; and forming a patch section by:

contacting the third sheet to the laminate layer of a third folded portion of the first end portion; and creating a bond between the third sheet and the third folded portion of the first end portion by applying a second temperature.

21. A method of forming a hybrid-construct bag, the method comprising:

providing a first sheet, the first sheet being a paper-based sheet having a laminate layer formed over at least a portion of the paper-based sheet, wherein the first sheet includes a first end, a second end opposite to the first end, a third end, and a fourth end opposite to the third end;

providing a second sheet different from the first sheet, the second sheet being a fabric-based sheet;

providing a third sheet different from the first sheet, the third sheet being a fabric-based sheet;

forming a bag body by:

forming a substantially tubular main body portion by securing the first end of the first sheet to the second end of the first sheet in such a way that an outer surface of the main body portion includes the laminate layer;

forming a first end portion by folding a plurality of portions of the third end of the first sheet in such a way that an outer surface of the first end portion includes the laminate layer; and forming a second end portion by folding a plurality of portions of the fourth end of the first sheet in such a way that an outer surface of the second end portion includes the laminate layer; and forming a valve section by:

forming a substantially tubular valve body using the second sheet;

contacting a first portion of the valve body to a first folded portion of the first end portion;

contacting a second portion of the valve body to a second folded portion of the first end portion, wherein the second portion of the valve body is opposite to the first portion of the valve body, and wherein the second folded portion of the first end portion faces the first folded portion of the first end portion; and applying a first temperature to the first end portion to:

create a bond between the first portion of the valve body and the first folded portion of the first end portion; and create a bond between the second portion of the valve body and the second folded portion of the first end portion.

* * * * *